US012747657B2

(12) United States Patent
Fu

(10) Patent No.: US 12,747,657 B2
(45) Date of Patent: Sep. 29, 2026

(54) METHODS FOR TIGHT OIL PRODUCTION THROUGH SECONDARY RECOVERY USING SPACED PRODUCER AND INJECTOR WELLBORES

(71) Applicant: Xuebing Fu, Houston, TX (US)

(72) Inventor: Xuebing Fu, Houston, TX (US)

( * ) Notice: Subject to any disclaimer, the term of this patent is extended or adjusted under 35 U.S.C. 154(b) by 0 days.

(21) Appl. No.: 18/454,269

(22) Filed: Aug. 23, 2023

(65) Prior Publication Data

US 2023/0392483 A1 Dec. 7, 2023

Related U.S. Application Data

(62) Division of application No. 17/157,209, filed on Jan. 25, 2021, now Pat. No. 11,773,704.

(60) Provisional application No. 63/002,569, filed on Mar. 31, 2020, provisional application No. 62/965,169, filed on Jan. 24, 2020.

(51) Int. Cl.
*E21B 43/16* (2006.01)
*E21B 43/14* (2006.01)

(52) U.S. Cl.
CPC ..... *E21B 43/162* (2013.01); *E21B 43/14* (2013.01)

(58) Field of Classification Search
CPC ..... E21B 43/162; E21B 43/14
See application file for complete search history.

(56) References Cited

U.S. PATENT DOCUMENTS

| | | | | |
|---|---|---|---|---|
| 4,724,905 | A | 2/1988 | Uhri | |
| 9,127,544 | B2 | 9/2015 | Dombrowski et al. | |
| 9,562,422 | B2 | 2/2017 | Sharma et al. | |
| 10,208,547 | B2 | 2/2019 | Kjorholt et al. | |
| 2011/0272152 | A1 | 11/2011 | Kaminsky et al. | |
| 2013/0220604 | A1* | 8/2013 | El-Rabaa | E21B 43/26 166/308.1 |
| 2014/0190691 | A1 | 7/2014 | Vinegar et al. | |
| 2015/0114623 | A1* | 4/2015 | Owens | E21B 43/26 166/248 |
| 2015/0369023 | A1 | 12/2015 | MacPhail et al. | |
| 2016/0177676 | A1* | 6/2016 | Lynch | E21B 41/0035 405/285 |
| 2017/0076022 | A1* | 3/2017 | Chin | G06F 30/28 |
| 2017/0284175 | A1 | 10/2017 | Colvin et al. | |

FOREIGN PATENT DOCUMENTS

RU 2660683 C1 7/2018

OTHER PUBLICATIONS

Bond et al., "Completion Optimization Provides Step Changes in Horizontal Well Performance in the Oooguruk Field, Alaska", *SPE Drilling & Completion*, Mar. 2017, 12 pages.
International Search Report and Written Opinion of the International Searching Authority issued in corresponding International Application No. PCT/US21/70074 mailed on Apr. 8, 2021.

* cited by examiner

*Primary Examiner* — Silvana C Runyan
(74) *Attorney, Agent, or Firm* — Polygon IP, LLP

(57) ABSTRACT

Some methods of production hydrocarbons from a formation comprise drilling two or more horizontal wellbores in the formation, at least a portion of each extending in a direction that is within 20 degrees of parallel to a direction of maximum horizontal stress of the formation. The horizontal wellbores can include one or more producer wellbores and one or more injector wellbores, each of the producer wellbore(s) separated from at least one of the injector wellbore (s) by a formation-permeability-dependent well spacing. Some comprise comprising creating one or more longitudinal fractures that are in communication with the formation in each of the horizontal wellbores, injecting a recovery fluid comprising gas into at least one of the injector wellbore(s) such that the recovery fluid flows into the formation, and receiving hydrocarbons from the formation into at least one of the producer wellbore(s).

26 Claims, 21 Drawing Sheets

METHODS FOR TIGHT OIL PRODUCTION THROUGH SECONDARY RECOVERY USING SPACED PRODUCER AND INJECTOR WELLBORES

CROSS-REFERENCE TO RELATED APPLICATIONS

The present application is a divisional of U.S. patent application Ser. No. 17/157,209, filed Jan. 25, 2021 and published as US 2021/0230989 A1 on Jul. 29, 2021, and claims benefit of U.S. Provisional Patent Application No. 62/965,169, filed Jan. 24, 2020, and U.S. Provisional Patent Application No. 63/002,569, filed Mar. 31, 2020, each of which are incorporated herein by reference in their entireties.

FIELD OF INVENTION

The present invention relates generally to methods for hydrocarbon production, and more specifically but without limitation to methods for increasing hydrocarbon recovery in a tight formation.

BACKGROUND

Current techniques for economic tight reservoir development involve drilling horizontal wells and completing the wells with multistage fracturing. The horizontal wells are typically drilled along the minimum stress direction; because fractures tend to open against the minimum stress direction during fracturing, a series of transverse fractures results, which are typically supported by sand or proppant with relatively high permeability. Such fracturing can yield a large contact area between the reservoir and the well, allowing natural reservoir pressure to support economic production rates. In the past decade, this technique has been used in various basins to yield increased petroleum production from tight formations.

While this technique has allowed economic access to hydrocarbons in tight formations (e.g. in which permeability is less than or equal to approximately 0.1 millidarcy), it typically still yields a relatively low recovery factor, generally below 10%. In conventional reservoirs (e.g. in which permeability greater than approximately 0.1, usually greater than 1 millidarcy), hydrocarbon recovery is sometimes increased using secondary recovery in which fluid is injected into one or more wells to sweep the reservoir, which allows hydrocarbons to be produced in one or more other wells when natural reservoir pressure declines. However, in tight formations in which multistage fractured horizontal wells are used, secondary recovery from one well to another is typically inefficient because some fractures between adjacent wells may be close to each other in distance. With the fracture permeability being much higher than the matrix permeability, the injected fluid tends to flow between two wells through some adjacent or connected fractures more predominantly than sweeping the matrix where most formation hydrocarbons reside.

Despite these challenges, some have proposed secondary recovery techniques in tight oil fields with fractured horizontal wells drilled along the direction of minimum horizontal stress through flooding between transverse fractures within a single well. One such technique is described in U.S. Pat. No. 9,127,544; the fracture-to-fracture flooding pattern described therein purportedly yields a high recovery. However, that process requires downhole systems that can isolate different fractures and allow injection and production through individual zones, such as the systems described in U.S. Pat. Nos. 9,127,544, 9,562,422, and 10,208,547 and Pub No. US 2015/0369023. These downhole systems may have non-standard components and/or require costly and challenging downhole operations for activation, and there has not yet been widespread, successful implementation thereof in single-well inter-fracture flooding processes.

Russian Patent No. 2660683 seeks to achieve higher oil recovery with a secondary recovery process in which horizontal wells are drilled in the direction of maximum horizontal stress and fractured to create longitudinal—rather than transverse—fractures along the wells. Although claimed to be targeting "low-permeability" reservoirs, the process is used in conventional reservoirs (e.g. a reservoir with a permeability of 0.87 millidarcy, in the example well) rather than unconventional tight reservoirs (e.g. in which the permeability is less than or equal to approximately 0.1 millidarcy), and thus did not demonstrate usability in low-permeability tight formations in which the predominant, standard recovery process is to drill in the minimum stress direction and conduct multistage hydraulic fracturing. Indeed, theoretical studies—such as that described in *Performance comparison of transverse and longitudinal fractured horizontal wells over varied reservoir permeability* by Fen Yang (M. S. Thesis, 2014)—have been carried out to compare the performance between longitudinal and transverse fractures during primary production but did not consider the feasibility of secondary recovery in unconventional reservoirs, underscoring the lack of consideration thereof in the art. Consistent with Russian Patent No. 2660683's conventional reservoir target, its process is employed with the goal of minimizing the distance between the rows of horizontal wells down to 300 meters (a rather large spacing). But the well-spacing-minimization focus with a 300-meter floor may yield less economic recovery than is possible with a different approach to well spacing. Additionally, in the process described therein water is injected into the formation for secondary recovery, which may have limited effectiveness on hydrocarbon recovery in tighter formations.

SUMMARY

There accordingly is a need in the art for a simple secondary recovery method in which a larger portion of hydrocarbons can be recovered from a tight formation. The present methods address this need with laterals or horizontal wellbores that include one or more producer wellbores and one or more injector wellbores, each of which has one or more sections that extend in a direction that is within 20 degrees (e.g., within 15 degrees) of parallel to the formation's direction of maximum horizontal stress and can be fractured such that one or more longitudinal fractures are created therein. For secondary recovery, a recovery fluid comprising gas can be injected into at least one of the injector wellbore(s) such that it enters the formation to support hydrocarbon production in the producer wellbore(s). The gas can be miscible with the formation hydrocarbons.

Compared to the common practice of fracturing horizontal wells drilled along the minimum horizontal stress direction to create transverse fractures, fracturing horizontal wells extending within 20 degrees of parallel to the direction of maximum horizontal stress to create longitudinal fractures allows for better secondary recovery. This is because using longitudinal fractures results in a displacement pattern of one-dimensional flow from one surface to another (the most efficient displacement pattern, which is also facilitated by a small gravity effect in a tight formation), yielding higher macroscopic sweep efficiencies. Additionally, the use of gas in the recovery fluid can yield a higher microscopic sweep efficiency in tight formations than water such that the injected gas more readily urges formation hydrocarbons into the producer wellbore(s) for production in a miscible fashion, with the efficiency approaching 100% in homogenous porous media. These two factors combined can contribute to higher overall sweep efficiencies.

The spacing between the producer and injector wellbores can further promote a more effective secondary recovery in tight formations than that achieved with existing techniques. The well spacing can depend on formation characteristics—one such characteristic is average formation permeability (in the flow direction, e.g., a direction substantially aligned with the direction of minimum stress), which can be a primary determinant of the appropriate well spacing. Smaller well spacing may be more suitable for low-permeability formations and may yield larger overall recovery by allowing faster depletion. However, the oil recovery advantage of a smaller well spacing may be less significant with higher formation permeabilities, and employing a smaller well spacing may require more wells to be drilled for full access to the formation, which may impose additional costs that offset the oil recovery advantage. With these considerations, to promote a more effective and economic secondary recovery, the well spacing between each of the producer well(s) and at least one of the injector well(s) can be:

(a) between 50 and 300 feet, when the formation's average permeability is between 0.001 and 0.005 millidarcy (mD);
(b) between 100 and 800 feet, when the formation's average permeability is between 0.005 and 0.01 mD;
(c) between 150 and 1500 feet, when the formation's average permeability is between 0.01 and 0.05 mD;
(d) between 200 and 2000 feet apart, when the formation's average permeability is between 0.05 and 0.1 mD;
(e) between 500 and 3000 feet, when the formation's average permeability is between 0.1 and 0.5 mD;
(f) between 800 and 4000 feet, when the formation's average permeability is between 0.5 and 2 mD.

Taking into account other formation characteristics and production parameters, an alternative advantageous well spacing may be within 10% of:

$$1.529\sqrt{\frac{k\Delta pT}{\phi(1-S_w)\mu}}\ \text{(ft)}$$

wherein k is an average permeability of the formation in millidarcy (mD), Δp is an average pressure differential between the producer wellbore and the injector wellbore in pounds per square inch, T is the target time to deplete the reservoir, Ø is an effective porosity of the formation, $S_w$ is a water saturation of the formation, and μ is the in-situ hydrocarbon viscosity, which can be estimated as a viscosity of the hydrocarbons in the formation in centipoise (cP) plus a viscosity of a recovery fluid in cP divided by two. Well spacings determined according to this relationship may be particularly suitable when the formation does not have a largely heterogeneous permeability, there are no severe short circuits between the producer and injector wellbores, the recovery fluid is miscible with the formation hydrocarbons, and/or $S_w$ is low (e.g., near critical water saturation). Reasonable target depletion times over which the relationship may yield advantageous well spacings include those between 0.5 and 20 years.

The improvement in oil recovery yielded by conducting gas-based secondary recovery through longitudinally-fractured horizontal wellbores spaced as described above may be substantial, with the oil recovery in some cases being at least two or three times that obtainable using existing techniques. Conducting secondary recovery in this manner may also have advantages over secondary recovery processes in which there is no fracturing or in which only vertical wells are used. Compared to drilling horizontal wells without fracturing, creating longitudinal fractures can enhance production rates, improve secondary recovery conformance, mitigate possible skin damage, and overcome undesirable vertical barriers in the reservoir. Compared to drilling and fracturing vertical wells, creating longitudinal fractures in horizontal wells can allow larger fractures to be created and the reservoir to be depleted with fewer wells, which can be more economic.

Some of the present methods of producing hydrocarbons from a formation comprise drilling two or more horizontal wellbores in the formation. At least a portion of each of the horizontal wellbores, in some methods, extends in a direction that is within 20 degrees, optionally within 15 degrees or within 10 degrees, of parallel to a direction of maximum horizontal stress of the formation. In some methods, the horizontal wellbores include one or more producer wellbores and one or more injector wellbores. Each of the producer wellbore(s), in some methods, is separated from at least one of the injector wellbore(s) by a well spacing. In some methods, the one or more producer wellbores comprise two or more producer wellbores, each positioned closer to at least one of the injector wellbore(s) than to each other of the producer wellbores and/or the one or more injector wellbores comprise two or more injector wellbores, each positioned closer to at least one of the producer wellbore(s) than to each other of the injector wellbores. In some methods, each of the producer wellbore(s) is spaced apart from a closest one of the injector wellbore(s) by the well spacing.

In some methods, the well spacing is between 50 and 300 feet and the average permeability of the formation is between 0.001 and 0.005 millidarcy (mD), the well spacing is between 100 and 800 feet and the average permeability of the formation is between 0.005 and 0.01 mD, the well spacing is between 150 and 1,500 feet and the average permeability of the formation is between 0.01 and 0.05 mD, or the well spacing is between 200 and 2,000 feet and the average permeability of the formation is between 0.05 and 0.10 mD. In some methods, the well spacing is between 500 and 3,000 feet and the average permeability of the formation is between 0.10 and 0.50 mD or the well spacing is between 800 and 4,000 feet, and the average permeability of the formation is between 0.50 and 2.0 mD. In some methods, the well spacing is within 10% of $$1.529\sqrt{\frac{k\Delta pT}{\phi(1-S_w)\mu}}$$

in feet, wherein k is an average permeability of the formation in millidarcies (mD), Δp is a differential between a target production pressure and a target injection pressure in pounds per square inch, T is between 0.5 and 20 years, Ø is an effective porosity of the formation, $S_w$ is a water saturation of the formation, and μ equals a viscosity of the hydrocarbons in the formation in centipoise (cP) plus a viscosity of a recovery fluid in cP divided by two. In some methods, the well spacing is less than or equal to 900 feet and/or the average permeability of the formation is less than or substantially equal to 0.10 mD.

Some methods comprise creating one or more longitudinal fractures that are in communication with the formation in each of the horizontal wellbores. Some methods comprise injecting a recovery fluid into at least one of the injector wellbore(s) such that the recovery fluid flows into the formation. The recovery fluid, in some methods, comprises gas. The gas, in some methods, comprises methane, ethane, propane, butane, carbon dioxide, and/or nitrogen. Some methods comprise receiving hydrocarbons from the formation into at least one of the producer wellbore(s).

In some methods, a depth of each of the horizontal wellbores is within 5% of a depth of each other of the horizontal wellbores. In some methods, drilling is performed such that at least two of the horizontal wellbores extend from a common vertical wellbore. In some methods, at least one of the producer wellbore(s) and/or at least one of the injector wellbore(s) has a length that is at least 10% shorter than a length of another one of the horizontal wellbores.

In some methods, the one or more producer wellbores comprise two or more producer wellbores and drilling is performed such that a first one of the producer wellbores is spaced apart from a second one of the producer wellbores by a distance that is at least 150% of the well spacing. In some of such methods, drilling is performed such that a first one of the injector wellbore(s) is spaced apart from each of the first and second producer wellbores by the well spacing and the first injector wellbore is drilled in the formation at least one year after the first and second producer wellbores are each drilled in the formation. In some of such methods, the first injector wellbore is positioned closer to the first producer wellbore and to the second producer wellbore than is the first producer wellbore to the second producer wellbore. In some methods, receiving hydrocarbons from the formation includes receiving hydrocarbons into the first and second producer wellbores before the first injector wellbore is drilled in the formation.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the terms "substantially," "approximately," and "about" may each be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, a product or system that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Each dimension herein provided in an English unit may be translated to the corresponding metric unit by rounding to the nearest millimeter.

Any embodiment of any of the products, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Figure 1:
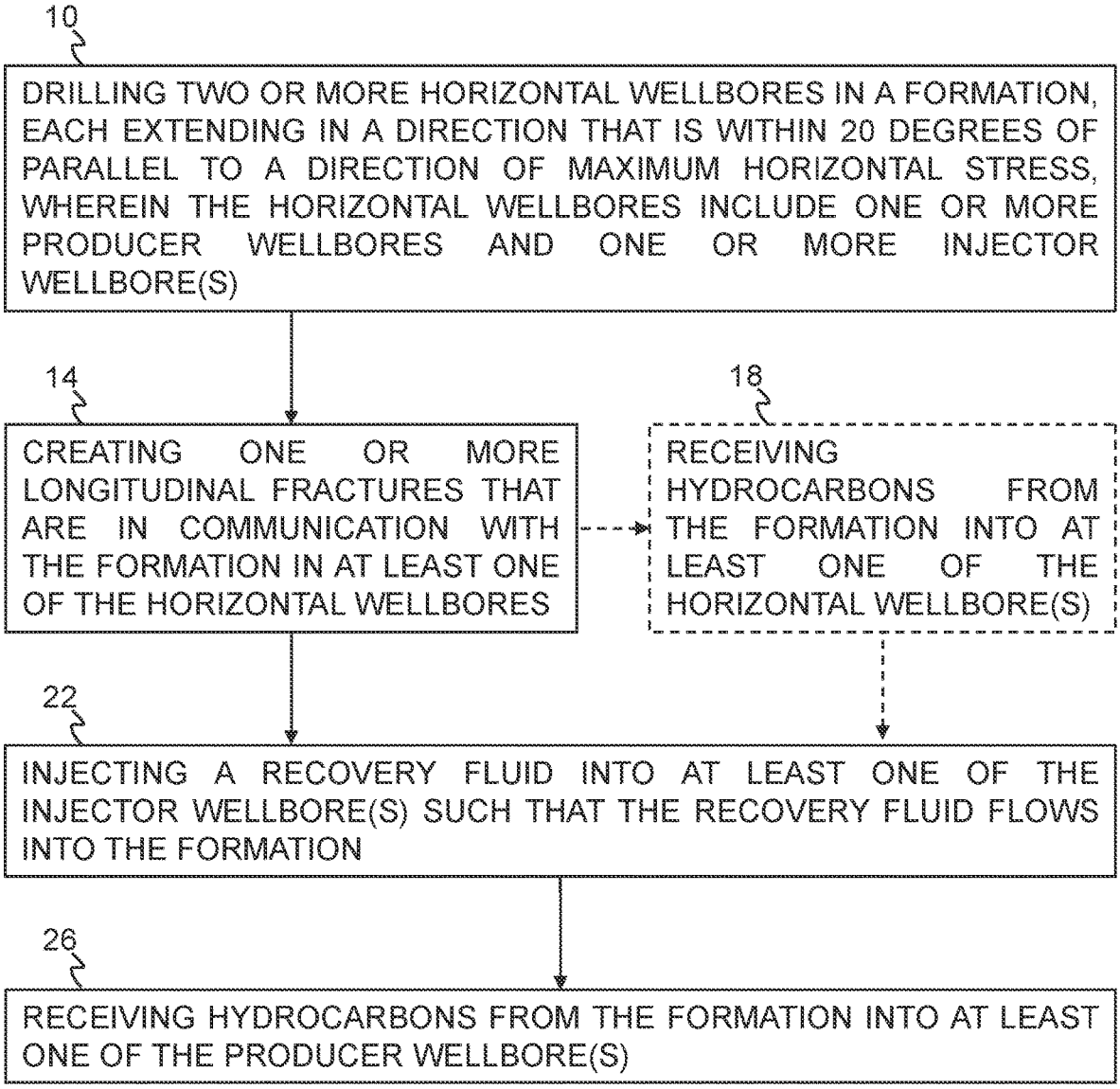
FIG. 1 illustrates some of the present methods of producing hydrocarbons from a formation.

FIG. 1 is a flowchart showing steps of some of the present methods of producing hydrocarbons from a formation, and FIGS. 2A-2E illustrate hydrocarbon recovery from a formation (e.g., 30) according to those steps. Some methods include a step 10 of drilling two or more horizontal wellbores or laterals (e.g., 34*a* and 34*b*) in the formation (FIG. 2A), the laterals including one or more producer wellbores (e.g., 34*a*) and one or more injector wellbores (e.g., 34*b*), such as greater than or equal to any one of, or between any two of, one, two, three, four, five, six, seven, eight, nine, ten, eleven, twelve, thirteen, fourteen, fifteen, or sixteen producer wellbores and greater than or equal to any one of, or between any two of, one, two, three, four, five, six, seven, eight, nine, ten, eleven, twelve, thirteen, fourteen, fifteen, or sixteen injector wellbores.

At least a portion of each of the laterals can extend in a direction that is substantially aligned with a direction of maximum horizontal stress (e.g., 38) of the formation, such as in a direction that is within 20, 15, 12, 10, 8, 6, 4, or 2 degrees of parallel to the direction of maximum horizontal stress; in some embodiments, however, at least a portion of each lateral can be substantially aligned in a direction that is further deviated from the maximum horizontal stress direction (e.g., within 45, 40, 35, 30, or 25 degrees of parallel to the direction of maximum horizontal stress). As shown, each of laterals 34*a* and 34*b* is drilled in the same direction (e.g., such that, for each lateral, the vertical wellbore from which the lateral extends is disposed closer to each of the vertical wellbore(s) from which the other laterals extend than is the opposing end or toe of the lateral). In other embodiments, however, at least some of laterals 34*a* and 34*b* can be drilled in different directions (e.g., in opposite but substantially parallel directions). For example, for each of producer wellbore(s) 34*a*, the vertical wellbore from which the producer wellbore extends can be disposed further from the vertical wellbore from which at least one of injector wellbore(s) 34*b* extends than is the opposing end or toe of the producer wellbore.

Each of laterals 34*a* and 34*b* can have a regular diameter or a relatively small diameter to reduce the cost of drilling (e.g., coiled tubing drilling), such as a diameter that is less than or equal to any one of, or between any two of, 10, 8.75, 8.5, 6.5, 6.0, 5.5, 4.75, 4, or 3 inches (e.g., in openhole diameter) and/or less than or equal to any one of, or between any two of, 8.75, 8.0, 7.0, 4.5, 4.0, 3.0, 2.875, or 2.50 inches (e.g., in casing diameter). Furthermore, a length of each of laterals 34*a* and 34*b* can be greater than or equal to any one of, or between any two of, 100, 200, 300, 400, 500, 750, 1000, 1500, 2000, 2500, 3000, 3500, 4000, 4500, 5000, 6000, 7000, 8000, 9000, 10000, 11000, 12000, 13000, 14000, or 15000 feet.

Figure 2A:
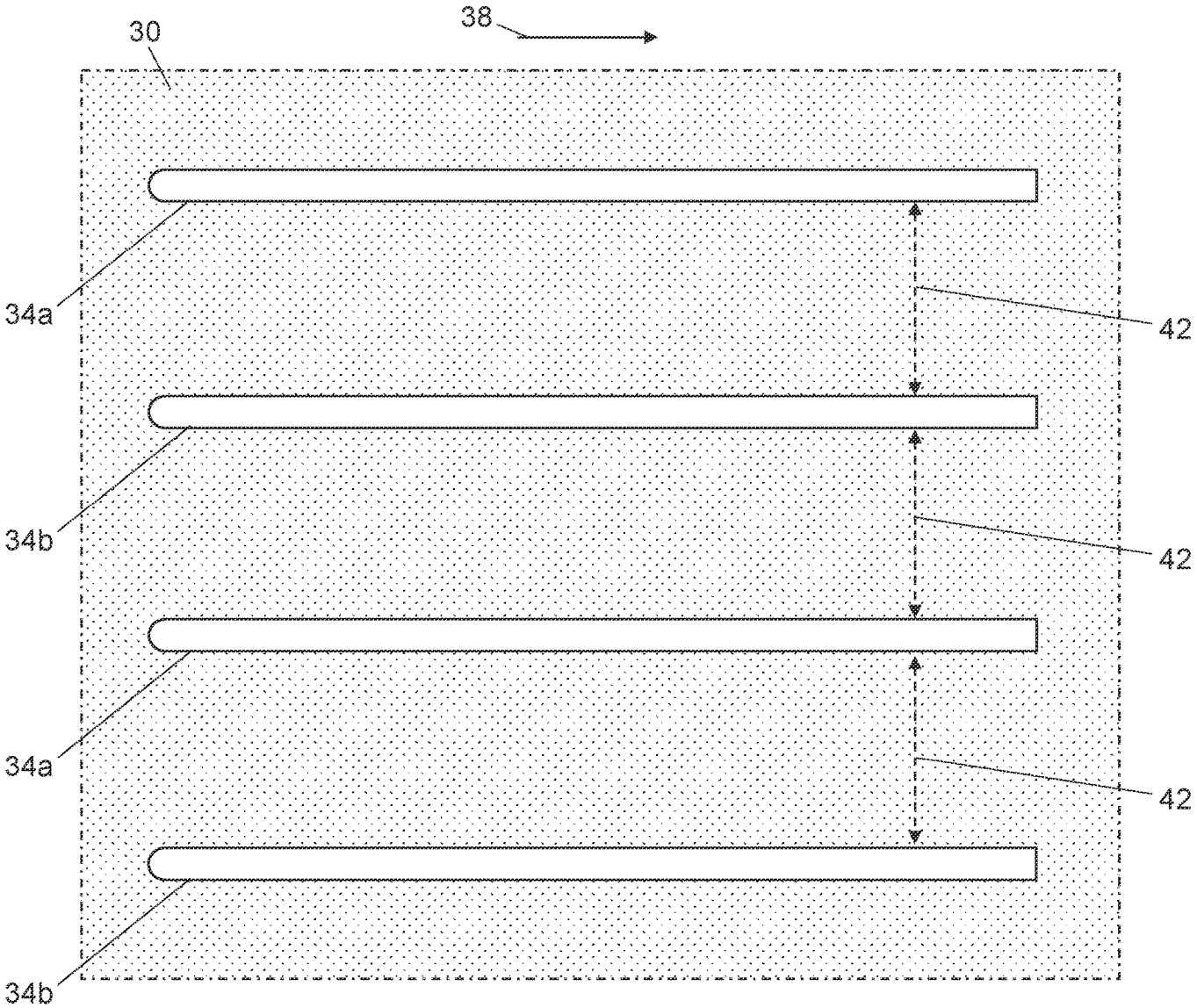
FIG. 2A is a top cross-sectional view of a formation showing horizontal wellbores or laterals drilled in a direction that is within 20 degrees of parallel of the formation's direction of maximum horizontal stress, the laterals including one or more producer wellbores and one or more injector wellbores.
Figure 2B:
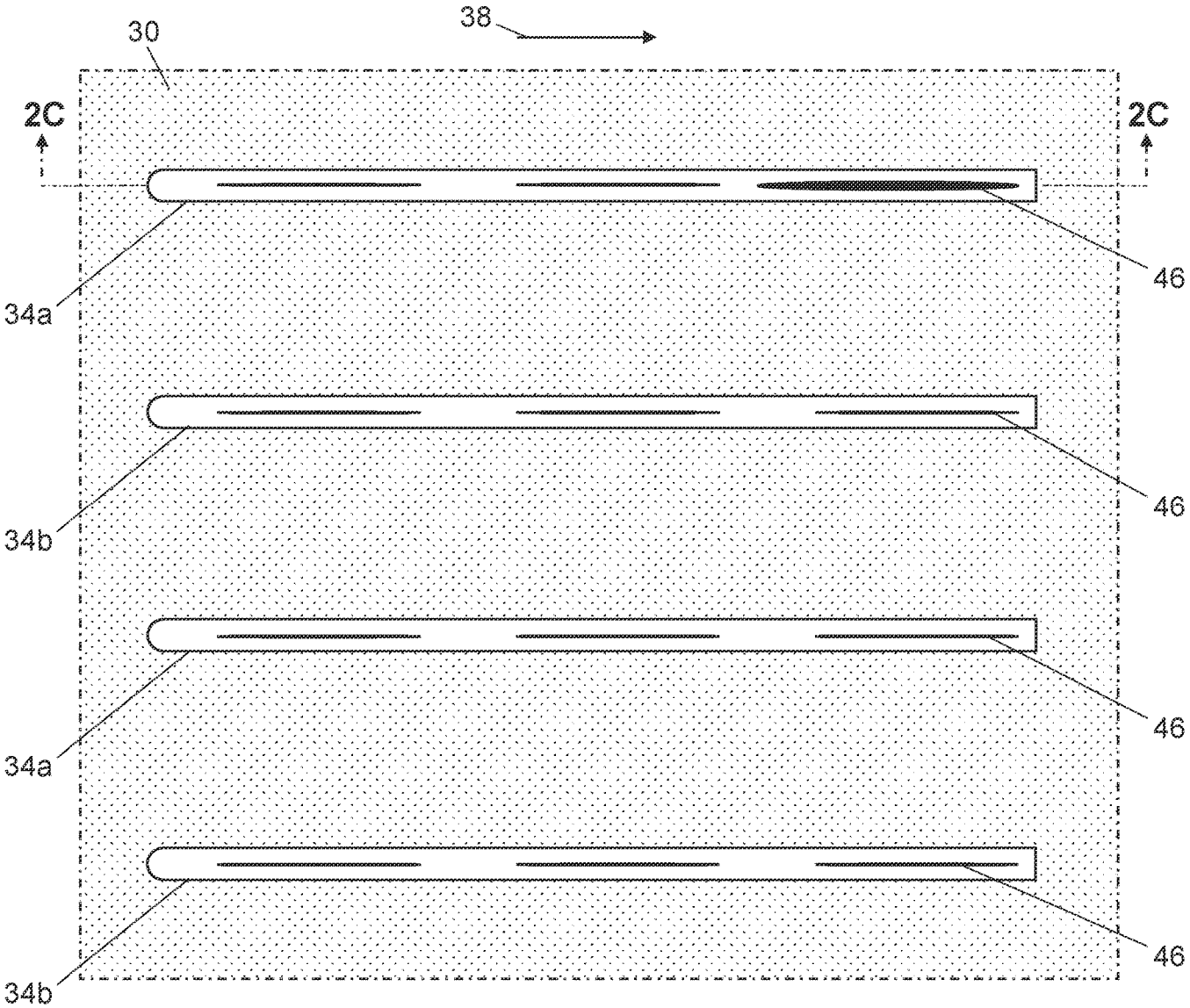
FIG. 2B is a top cross-sectional view of the formation of FIG. 2A, with one or more longitudinal fractures being created in each of the laterals.
Figure 2C:
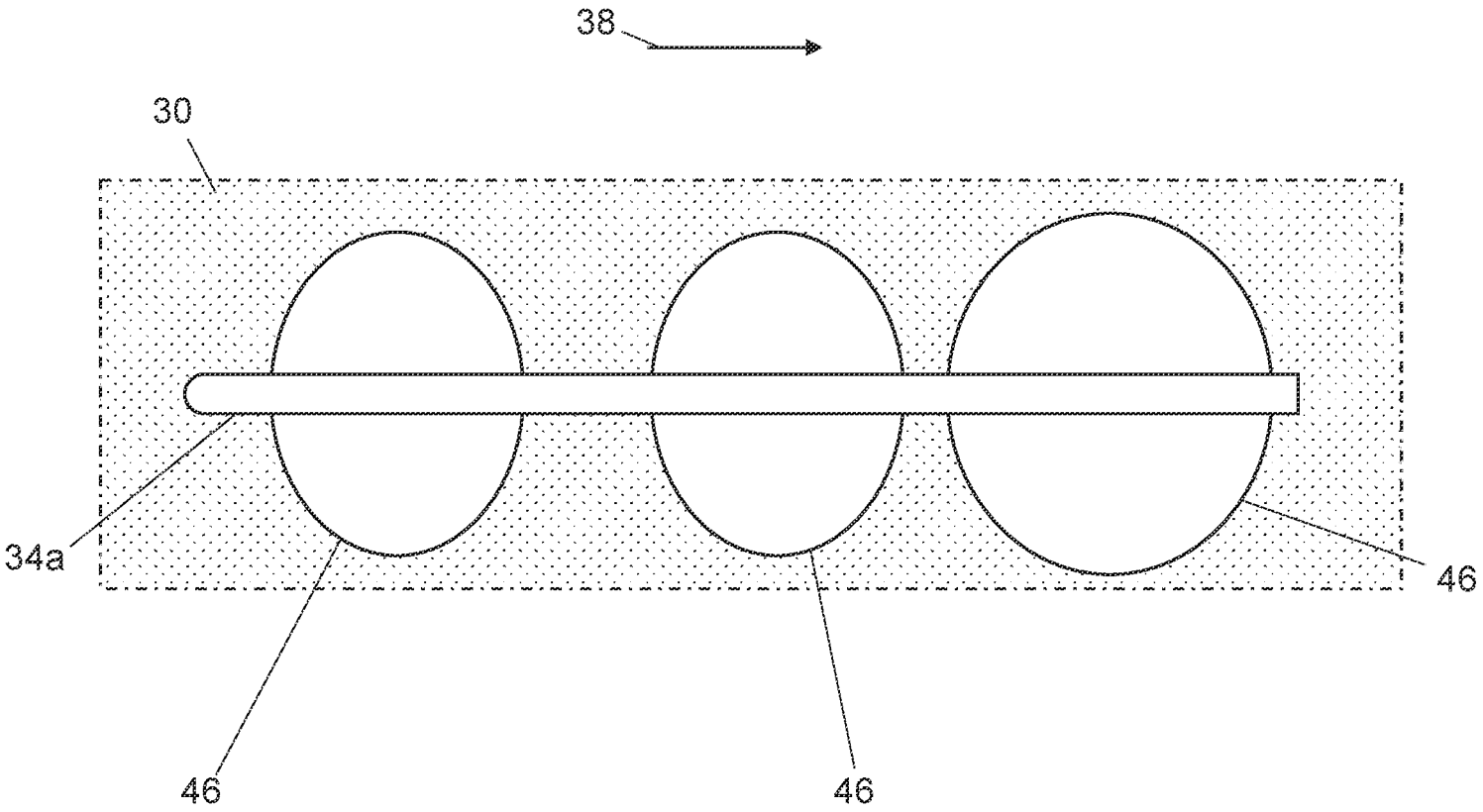
FIG. 2C is a side cross-sectional view of one of the fractured horizontal wellbores of FIG. 2B taken along line 2C-2C.
Figure 2D:
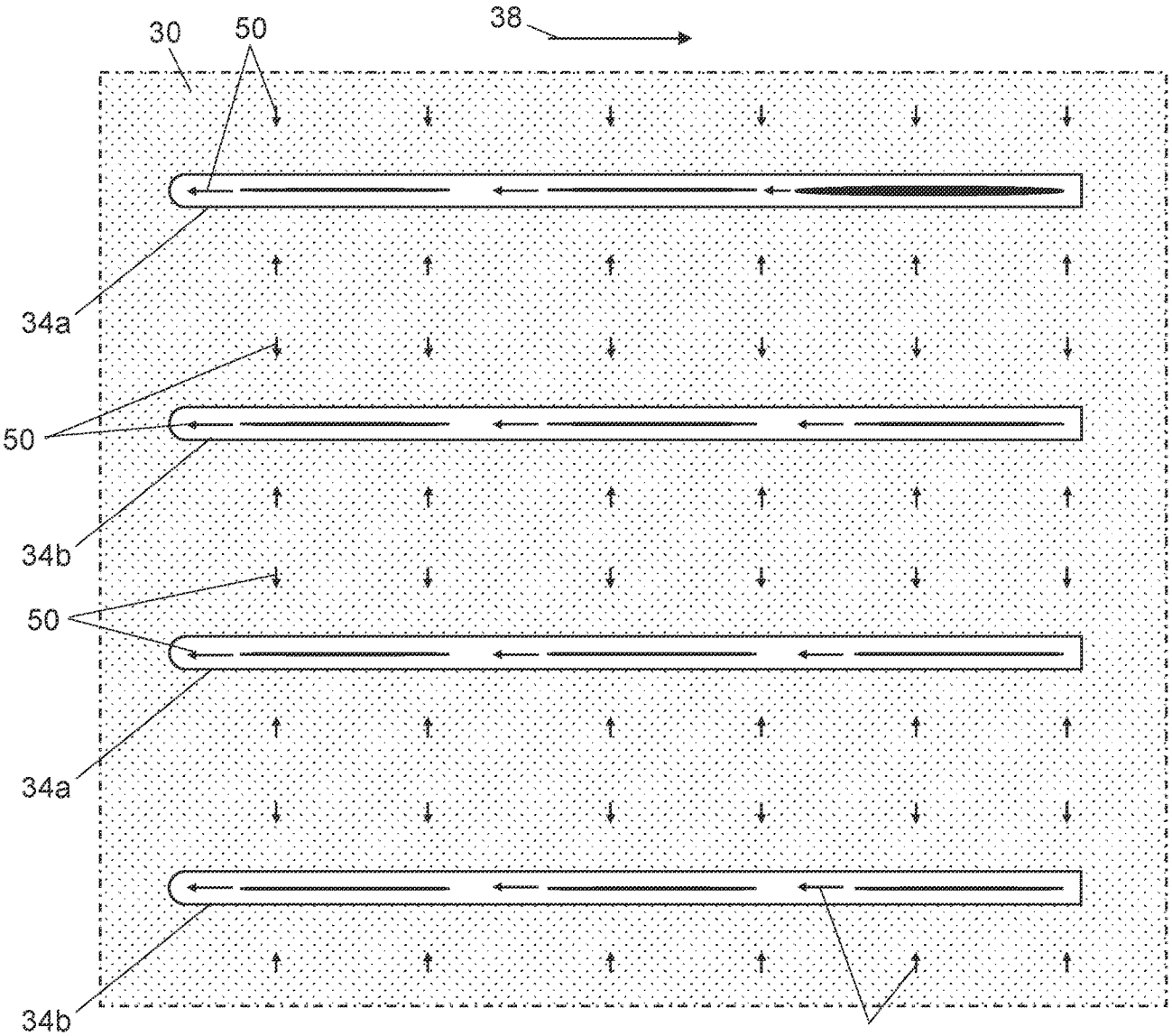
FIG. 2D is a top cross-sectional view of the formation of FIG. 2A and illustrates primary production in which each of the laterals receives hydrocarbons from the formation before secondary recovery.

Some methods include a step 14 of creating one or more longitudinal fractures (e.g., 46) in communication with the formation in at least one—up to and including each—of the laterals (FIGS. 2B and 2C). Any suitable fracturing fluid can be used; for example, and without limitation, a higher-viscosity fracturing fluid (e.g., a gel frac) can be used to facilitate the production of planar fractures, such as a fluid with a viscosity that is greater than or equal to any one of, or between any two of, 35, 36, 37, 38, 39, 40, 41, 42, 43, 44, or 45 centipoise (cP). Each lateral in which fracture(s) are created can be fractured along its entire length or along only a portion thereof. The laterals' substantial alignment with the maximum horizontal stress direction facilitates the creation of longitudinal rather than transverse fractures, which in turn can promote larger hydrocarbon recovery in the below-described secondary recovery process. The fracture (s) can be created in at least one (e.g., each) of the producer wellbore(s) and/or in at least one (e.g., each) of the injector wellbore(s); any unfractured lateral may be completed with an openhole, a cased and perforated hole, a liner, a frac pack, and/or one or more flow control devices. Accordingly, a fracture-to-fracture, lateral-to-fracture, or fracture-to-lateral flooding pattern can result between adjacent laterals during secondary recovery.

The location and dimensions of each fracture can be at least partially controlled by completion design and execution. The entry point(s) through which each fracture is created (e.g., perforation(s), or whose positioning is based on the positioning of sliding sleeve(s) (if used)) can be at the top, bottom, and/or side of the wellbore (e.g., of the casing or liner). As shown the entry point(s) for each of the longitudinal fracture(s) are positioned at the top and bottom of the lateral thereof such that the longitudinal fracture projects substantially vertically from the lateral; in other embodiments with different entry point(s) the fracture can project from a lateral in a different direction (e.g., substantially horizontally). The height growth of a fracture may be contained within one formation, or guided toward penetrating multiple stacked pay zones. If multiple longitudinal fractures are created, the intensity of pumping and size of proppant may be different at different stages along the lateral (e.g. more proppant can be pumped at stages near the toe than those near the heel along the lateral to promote an even distribution of injected gas and/or an even production along the lateral during secondary recovery). Fracturing can be performed such that adjacent fractures of a lateral overlap with each other or are spaced apart. Furthermore, while as shown the longitudinal fracture(s) each extend in a direction substantially aligned with the lateral thereof, in other embodiments the fracture(s) can extend in a direction that slightly angularly disposed relative to the direction in which the lateral extends (e.g., if the lateral extends in a direction that is angularly disposed relative to the formation's maximum horizontal stress direction by 15 degrees, or if the in-situ stress situation is complicated by disturbance).

Some methods optionally include a primary recovery step 18 in which hydrocarbons (e.g., 50) flow from the formation into at least one—up to and including each—of the producer and injector wellbores (FIG. 2D) before secondary recovery. The hydrocarbons can flow to the surface via one or more vertical wellbores from which the hydrocarbon-receiving lateral(s) extend.

Figure 2E:
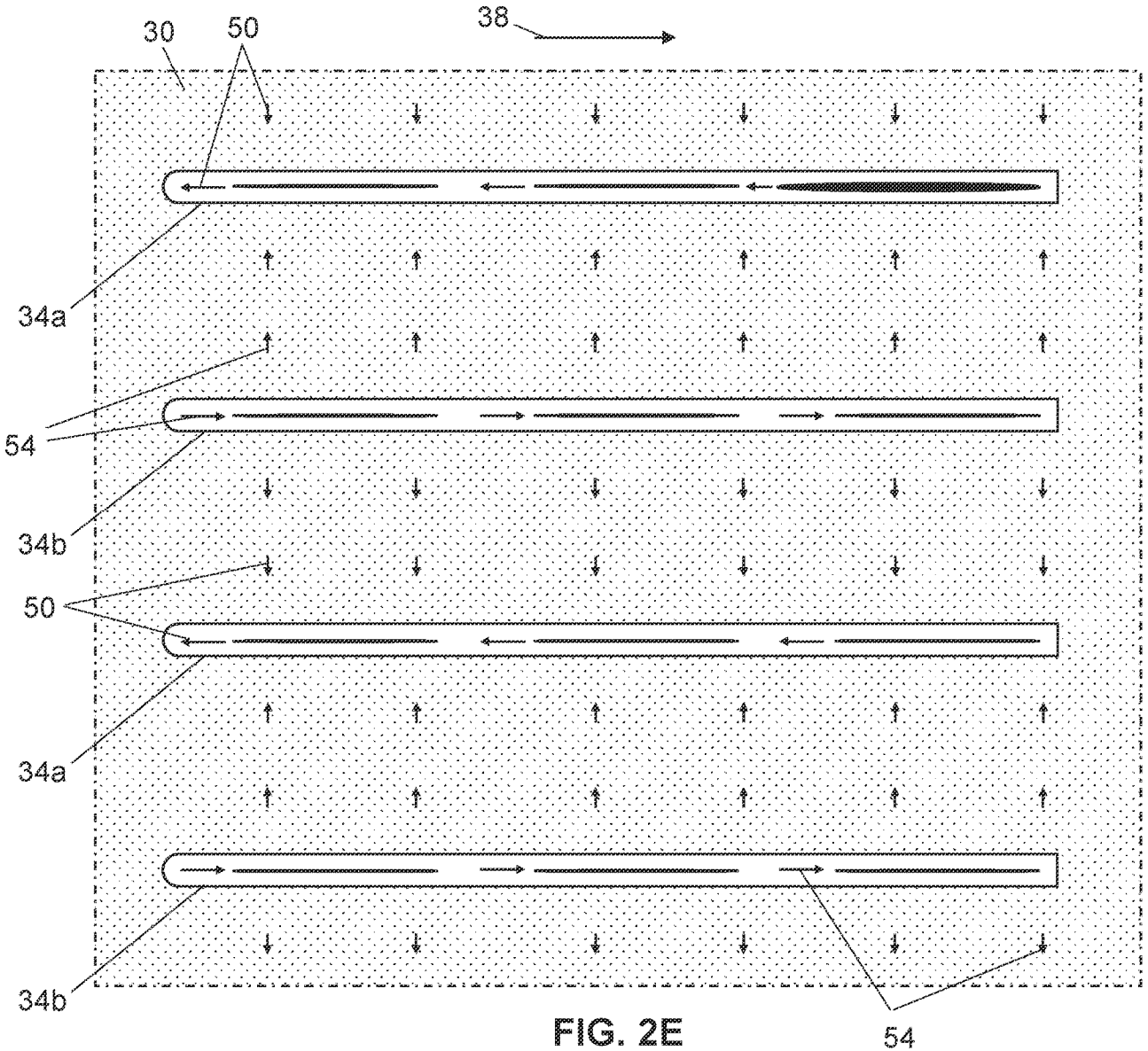
FIG. 2E is a top cross-sectional view of the formation of FIG. 2A and illustrates gas flooding in which gas is injected into at least one of the injector lateral(s) and hydrocarbons from the formation are received in at least one of the producer lateral(s).

Regardless of whether primary recovery supported by natural reservoir pressure occurs, some methods include a step 22 of injecting a recovery fluid (e.g., 54) comprising gas into at least one—up to and including each—of the injector wellbore(s) and a step 26 of receiving hydrocarbons from the formation into at least one—up to and including each—of the producer wellbore(s) (FIG. 2E). The injection of the recovery fluid can support hydrocarbon production through the producer wellbore(s) such that the hydrocarbons received therein can flow to the surface even if natural reservoir pressure would not otherwise support such recovery. By injecting gas into a lateral and producing hydrocarbons from adjacent laterals, a fracture-to-fracture, lateral-to-fracture, or fracture-to-lateral flooding process is conducted. The pressures at the injector and producer wellbores may vary during flooding. Hydrocarbon production at the surface can occur during and/or after injection of the recovery fluid; for example, toward the end of flooding when most of the produced fluid is the injected gas, injection into the injector wellbore(s) may be stopped first, and the producer wellbore(s) may continue producing until a threshold reservoir pressure or an economic limit is reached.

Using gas for the recovery fluid can better promote secondary recovery in tight formations than water (e.g., particularly when the average permeability of the formation is less than or equal to 0.10 mD) due to the microscopic sweep efficiency yielded by the gas. The gas can be miscible with the formation hydrocarbons to facilitate the production thereof. For example, the gas can include one or more hydrocarbons (e.g., methane ($CH_4$), ethane ($C_2H_6$), propane ($C_3H_8$), and/or butane ($C_4H_{10}$)), carbon dioxide ($CO_2$), and/or nitrogen ($N_2$). The secondary recovery fluid can also include one or more liquids such as water or chemicals to assist gas flooding; the liquid(s) can be injected with the gas, before the gas is injected, or after the gas is injected. Nevertheless, the recovery fluid can principally comprise gas, e.g., greater than or equal to any one of, or between any two of, 60%, 70%, 80%, or 90% of the recovery fluid, by volume (e.g., as measured at injection pressure) and/or weight, can be gas over at least a period of injection.

The laterals can be positioned such that each of the producer wellbore(s) is adjacent to one or two of the injector wellbore(s). As shown, moving along the row of laterals, the laterals can alternate between producer and injector wellbores, e.g., when there are multiple producer wellbores, each can be positioned closer to at least one (or two, for at least one producer wellbore) of the injector wellbore(s) than to each other of the producer wellbores, and when there are multiple injector wellbores, each can be positioned closer to at least one (or two, for at least one injector wellbore) of the producer wellbore(s) than to each other of the injector wellbores. Such positioning can promote sweep efficiency during secondary recovery by facilitating the flow of injected fluid toward the producer wellbore(s).

Each of the producer wellbore(s) can be separated from at least one (or two, for at least one producer wellbore) of the injector wellbore(s) by a well spacing (e.g., 42) that can promote effective secondary recovery. Reservoir properties-including reservoir thickness, porosity, permeability, heterogeneity, oil saturation, and the properties of fluids therein—and operational parameters—including well spacing, fracturing intensity, recovery fluid selection, and operating pressures—can have an impact on secondary oil recovery. Among these properties and parameters, reservoir permeability and well spacing can be critical for the performance of wellbores extending in a direction that is substantially aligned with the direction of maximum horizontal stress. Smaller well spacing may be required for effective recovery in low-permeability formations and can yield larger and faster hydrocarbon recovery compared to larger well spacings for at least some formation permeabilities. However, for higher-permeability formations, the oil recovery advantage of smaller well spacings may be less significant, and the use of smaller well spacings may disadvantageously require more wells to be drilled to fully access the hydrocarbon reservoir in the formation. As reflected in Example 1 below, when balancing these considerations, more effective gas-based secondary recovery can be achieved with a well spacing that is (a) less than or equal to any one of, or between any two of, 300, 275, 250, 225, 200, 175, 150, 125, 100, or 50 feet (e.g., between 50 and 300 feet), when the formation's average permeability is between 0.001 and 0.005 millidarcy (mD), (b) less than or equal to any one of, or between any two of, 800, 750, 700, 650, 600, 550, 500, 450, 400, 350, 300, 250, 200, 150, or 100 feet (e.g., between 100 and 800 feet), when the formation's average permeability is between 0.005 and 0.01 mD, (c) less than or equal to any one of, or between any two of, 1500, 1250, 1000, 750, 500, 250, 200, or 150 feet (e.g., between 150 and 1500 feet), when the formation's average permeability is between 0.01 and 0.05 mD, (d) less than or equal to any one of, or between any two of, 2000, 1750, 1500, 1250, 1000, 750, 500, 400, 300, or 200 feet (e.g., between 200 and 2000 feet), when the formation's average permeability is between 0.05 and 0.1 mD, (e) less than or equal to any one of, or between any two of, 3000, 2500, 2000, 1500, 1000, 750, 500, 400, or 300 feet (e.g., between 500 and 3000 feet), when the formation's average permeability is between 0.1 and 0.5 mD, or (f) less than or equal to any one of, or between any two of, 6000, 5500, 5000, 4500, 4000, 3500, 3000, 2500, 2000, 1500, 1000, 750, 500, or 450 feet (e.g., between 800 and 4000 feet), when the formation's average permeability is between 0.5 and 2 mD.

Alternatively, the well spacing can be based on a material balance and Darcy's equation as derived below. The original-oil-in-place (OOIP) in reservoir barrels (rb) can be expressed as:

$$\text{OOIP}=LA\varnothing(1-S_w) \quad (1)$$

and the steady-state production rate (q) during gas-based secondary recovery in reservoir barrels per day (rb/d) can be expressed as:

$$q = \frac{kA\Delta p}{\mu L} \tag{2}$$

From Eqs. 1 and 2, the time to deplete the formation's hydrocarbons (T) in days is:

$$T = \frac{OOIP}{q} = \frac{L^2\phi(1 - S_w)\mu}{k\Delta p} \tag{3}$$

where L is the well spacing, Ø is the effective porosity of the formation, $S_w$ is the average water saturation of the formation, μ is the fluid viscosity of the hydrocarbon phase in-situ, k is the is the average formation permeability, and Δp is the difference between a target injection pressure for an injector wellbore and a target production pressure for a producer wellbore, where when injecting the recovery fluid and/or receiving hydrocarbons from the formation, a pressure in each of the producer wellbore(s) receiving hydrocarbons is within 20%, 18%, 16%, 14%, 12%, or 10% of the target production pressure and a pressure in each of the injector wellbore(s) into which the recovery fluid is injected is within 20%, 18%, 16%, 14%, 12%, or 10% of the target injection pressure. The fluid viscosity μ may be estimated as the average of (1) a viscosity of the recovery fluid and (2) a viscosity of the formation hydrocarbons (e.g., oil or condensate) at reservoir conditions (e.g., the hydrocarbon viscosity plus the recovery fluid viscosity divided by two). The average formation permeability k can be the average relative permeability of the hydrocarbon phase in the flow direction (e.g., a direction substantially aligned with the formation's minimum stress direction) or (because relative permeability can be difficult to measure and can change as phase saturation changes during a flooding process) can be estimated as the absolute permeability multiplied by a factor that is between 0 and 1 (e.g., between approximately 0.5 and 1 for water-wet rocks, between approximately 0.2 and 0.8 for oil-wet rocks, or between 0.4 and 0.9 for mixed wet rocks).

Rearranging Eq. 3 to solve for the well spacing L yields:

$$L = \sqrt{\frac{k\Delta pT}{\phi(1 - S_w)\mu}} \tag{4}$$

and when using oilfield units (k in mD, Δp in pounds per square inch (PSI), μ in centipoise, and T in years), the well spacing in feet is:

$$L = 1.529\sqrt{\frac{k\Delta pT}{\phi(1 - S_w)\mu}} \tag{5}$$

For each producer wellbore, the well spacing between the producer wellbore and at least one of the injector wellbore(s) can be within 10% of the value yielded by Eq. 5. At least some of the parameters in Eq. 5 can be measured using prior flow data, including data regarding fluid viscosity and relative permeability; pilot tests using horizontal laterals drilled in a direction substantially aligned with the maximum horizontal stress direction and longitudinally fractured may be conducted to calibrate the equation effectively. Well spacings determined according to Eq. 5 may yield particularly effective secondary recovery when the formation is relatively homogeneous, no severe short circuits (often caused by high-permeability streaks and/or fractures) exist between the producer and injector wellbores, the recovery fluid is miscible with the formation hydrocarbons, and/or $S_w$ is relatively low (e.g., less than or equal to 50%, or less than or equal to two times the critical water saturation ($S_{wc}$) of the formation). Additionally, the target time for depletion T can be greater than or equal to any one of, or between any two of, 0.5, 1, 2, 3, 4, 5, 6, 7, 8, 9, 10, 11, 12, 13, 14, 15, 16, 17, 18, 19, or 20 years (e.g., between 0.5 and 20 years or between 0.5 and 15 years); while the well spacing can be determined with such target times, secondary recovery can be performed over a time period that is shorter or longer than the target time (e.g., if changing conditions warrant a different injection or production rate).

As shown, any of the above-described well spacings can be that between adjacent laterals. That is, for each of the producer wellbore(s), the well spacing can be the distance between the producer wellbore and a closest one of the injector wellbore(s) (and for at least one of the producer wellbore(s), between the producer wellbore and a second closest one of the injector wellbore(s)). When there are multiple producer and/or injector wellbores, the well spacings between the producer and injector wellbores can each be within one of the above-described ranges or within 10% of Eq. 5, and the well spacings can but need not be the same. Additionally, as shown the laterals can be disposed at substantially the same depth such that the well spacing occurs principally in a direction perpendicular to the maximum horizontal stress direction, e.g., a depth of each of the laterals can be within 10%, 9%, 8%, 7%, 6%, 5%, 4%, 3%, 2%, or 1% (e.g., within 5%) of a depth of each other of the laterals.

Well spacings determined in either of the above-described manners may be particularly advantageous for secondary recovery in tight formations that have a relatively low average permeability, such as an average permeability that is less than or equal to any one of, or between any two of, 0.10, 0.05, 0.04, 0.03, 0.02, 0.01, 0.005, 0.004, 0.003, 0.002, or 0.001 mD. Of the potential well spacings for such low permeabilities as determined in one of the above-described manners, those that are relatively small (e.g., those that do not exceed 900 feet) may tend to yield more oil recovery without requiring an undue amount of wells to be drilled for full access to the hydrocarbon reservoir in the formation.

Figure 3:
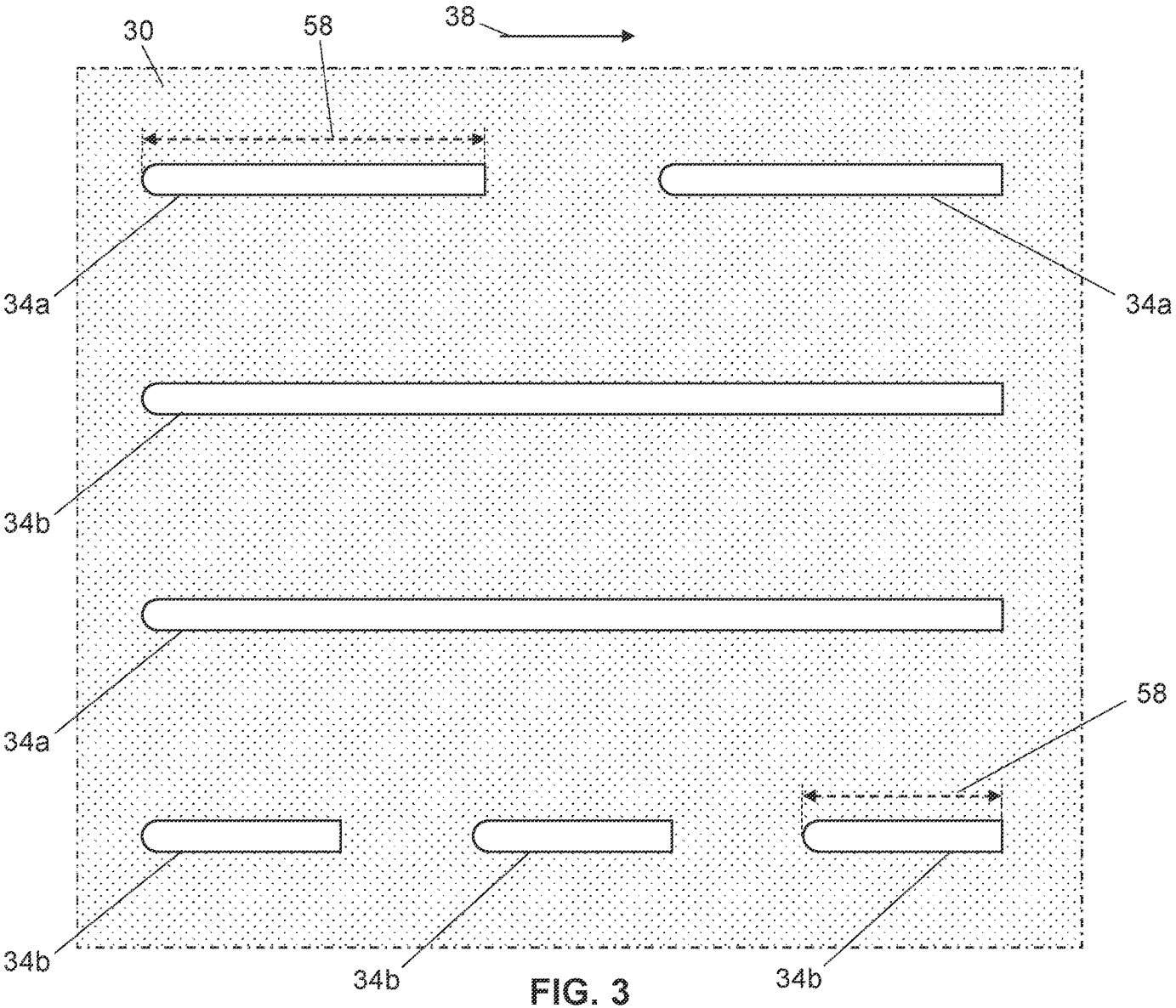
FIG. 3 is a top cross-sectional view of a formation in which at least one of two or more laterals drilled in the formation has a different length than another one of the laterals.

Referring to FIG. 3, while the laterals in FIGS. 2A-2E have substantially the same length, in other embodiments at least one of the producer wellbore(s) and/or at least one of the injector wellbore(s) can have a length (e.g., 58) that is at least 10%, 20%, 30%, 40%, 50%, 60%, 70%, or 80% shorter than a length of another one of the horizontal wellbores. Such setups may be desirable if certain parts of the reservoir are not suitable for fracturing (e.g., reservoir sections with faults) and/or to accommodate the lease area, existing wellbore(s), or infrastructure.

Figure 4:
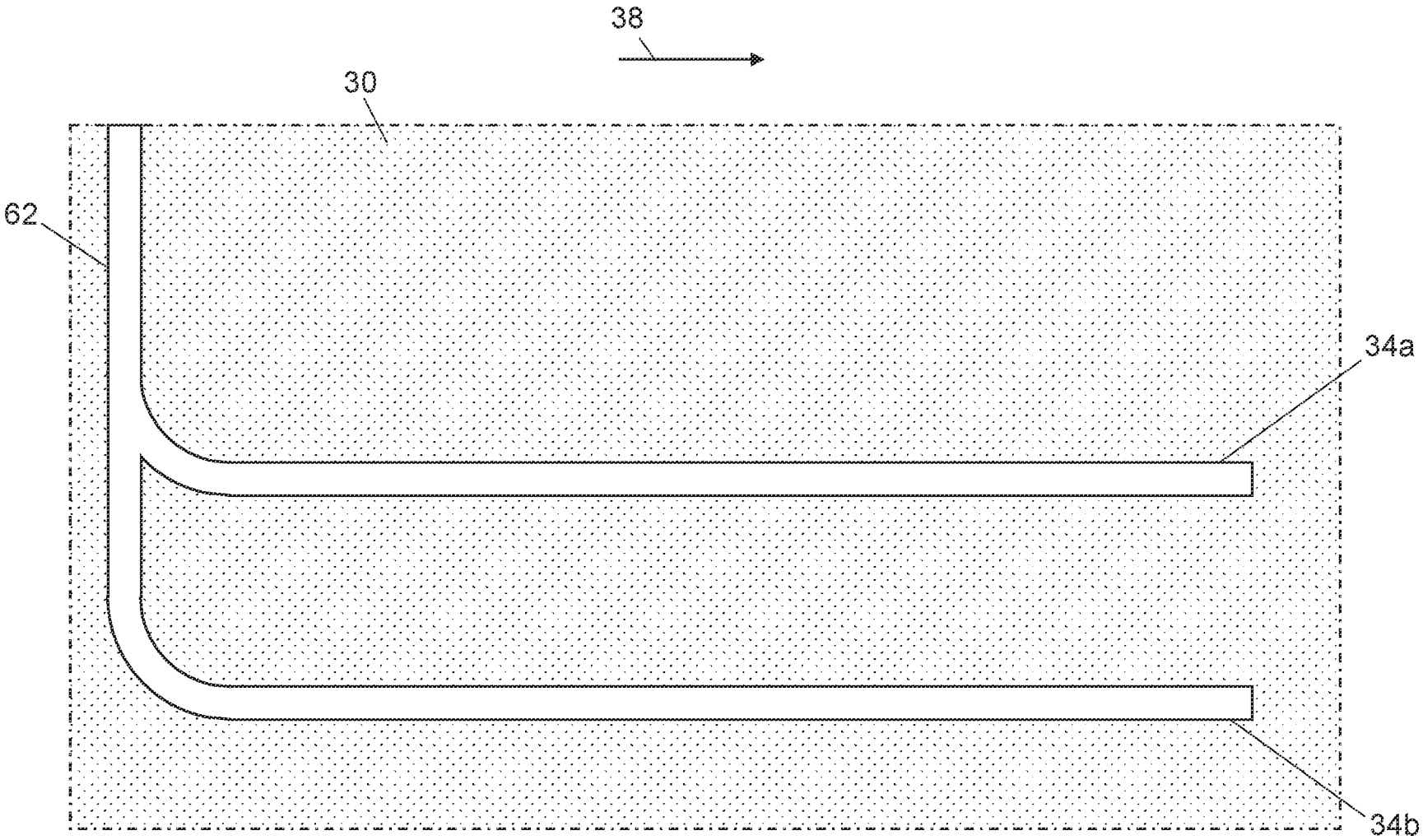
FIG. 4 is a side cross-sectional view of a formation in which at least two of two or more laterals drilled in the formation extend from a common vertical wellbore.

Turning to FIG. 4, while in FIGS. 2A-2E each of the laterals extends from a respective vertical wellbore, in some methods drilling is performed such that at least two—up to and including each—of the laterals extends from a common vertical wellbore (e.g., 62), which by reducing the amount of vertical wellbores to be drilled can help minimize surface interruption and save cost. For each common vertical wellbore, the laterals extending therefrom can all be injector wellbores, can all be producer wellbores, or can include both injector and producer wellbores. If there is one reservoir target, laterals extending from the common vertical wellbore may be drilled into different areal locations in the reservoir. If multiple reservoir targets are stacked together, at least some of the laterals extending from the common vertical wellbore may be drilled into different ones of the reservoirs. Both cases allow laterals to be drilled in rows, or into opposite directions in the reservoir(s). Common vertical wellbores may yield particularly good secondary recovery with gas flooding and laterals extending in the maximum horizontal stress direction because during flooding there may be relatively low and stable rates at each lateral in a tight formation. Each common vertical wellbore preferably includes one or more downhole control devices to allow individual control of the laterals extending therefrom.

Figure 5A:
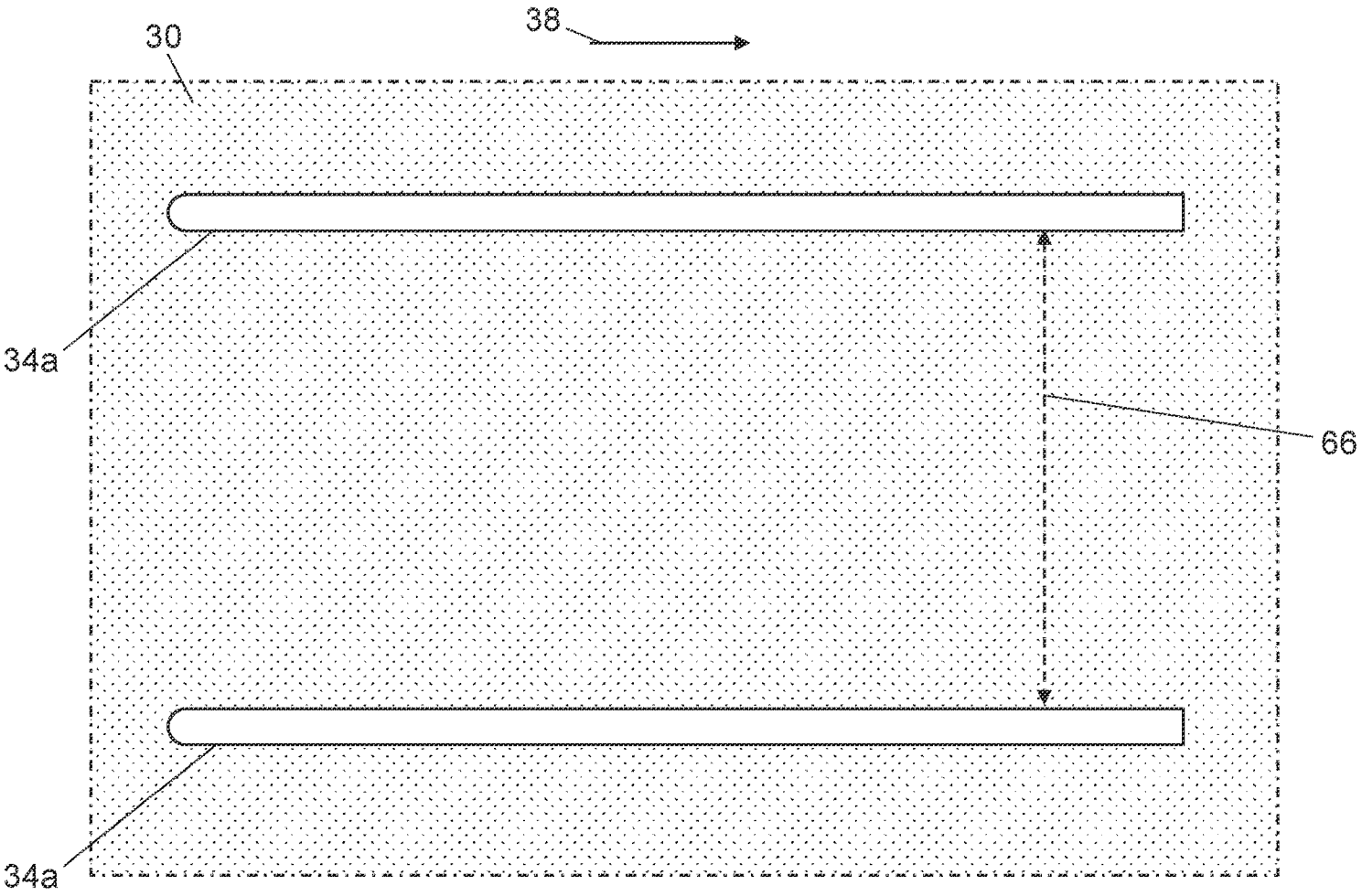
FIGS. 5A-5C are top cross-sectional views of a formation in which two laterals are drilled in the formation's direction of maximum horizontal stress, longitudinal fractures are created therein, and primary production occurs in the laterals.
Figure 5B:
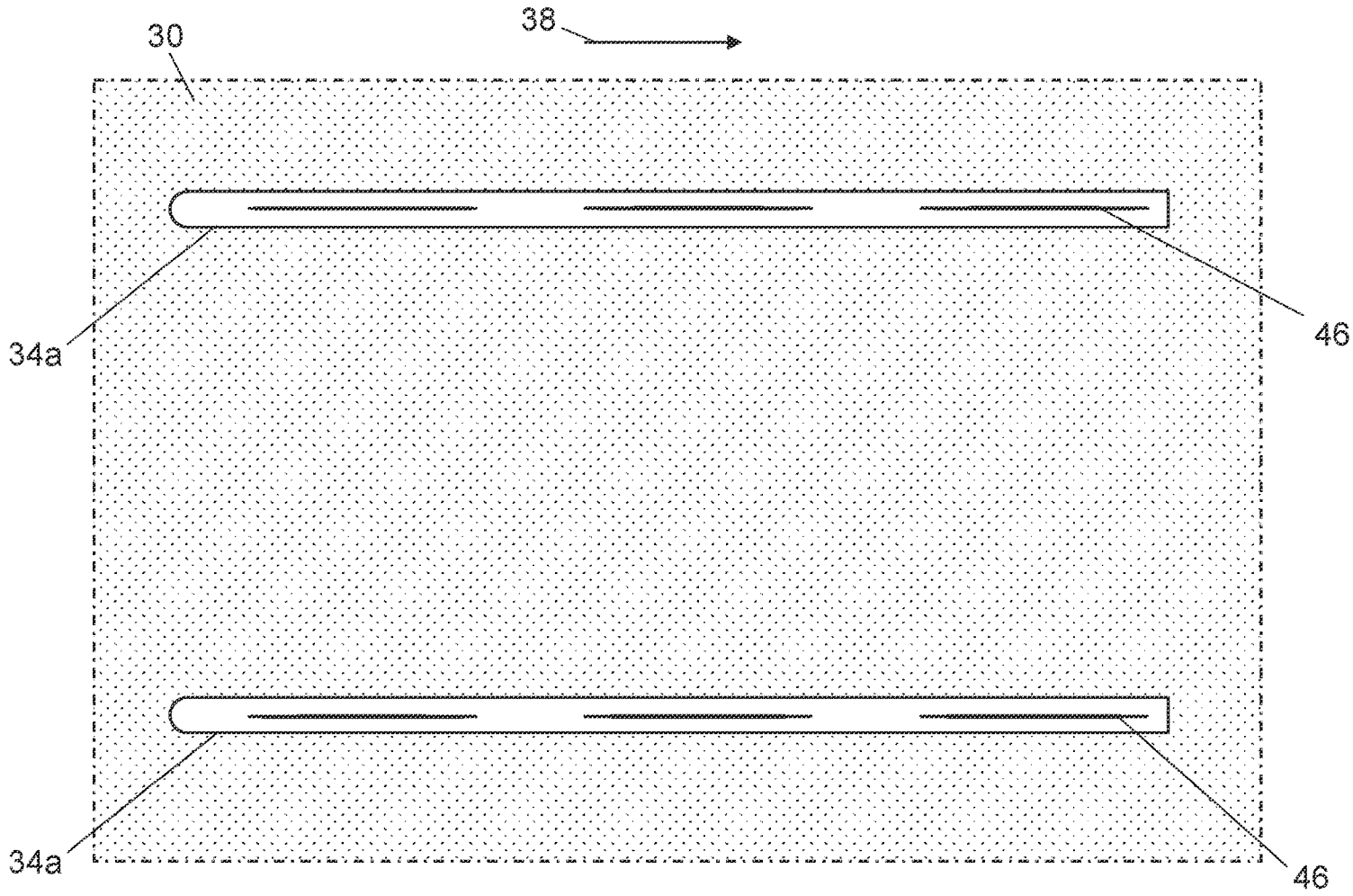
Figure 5C:
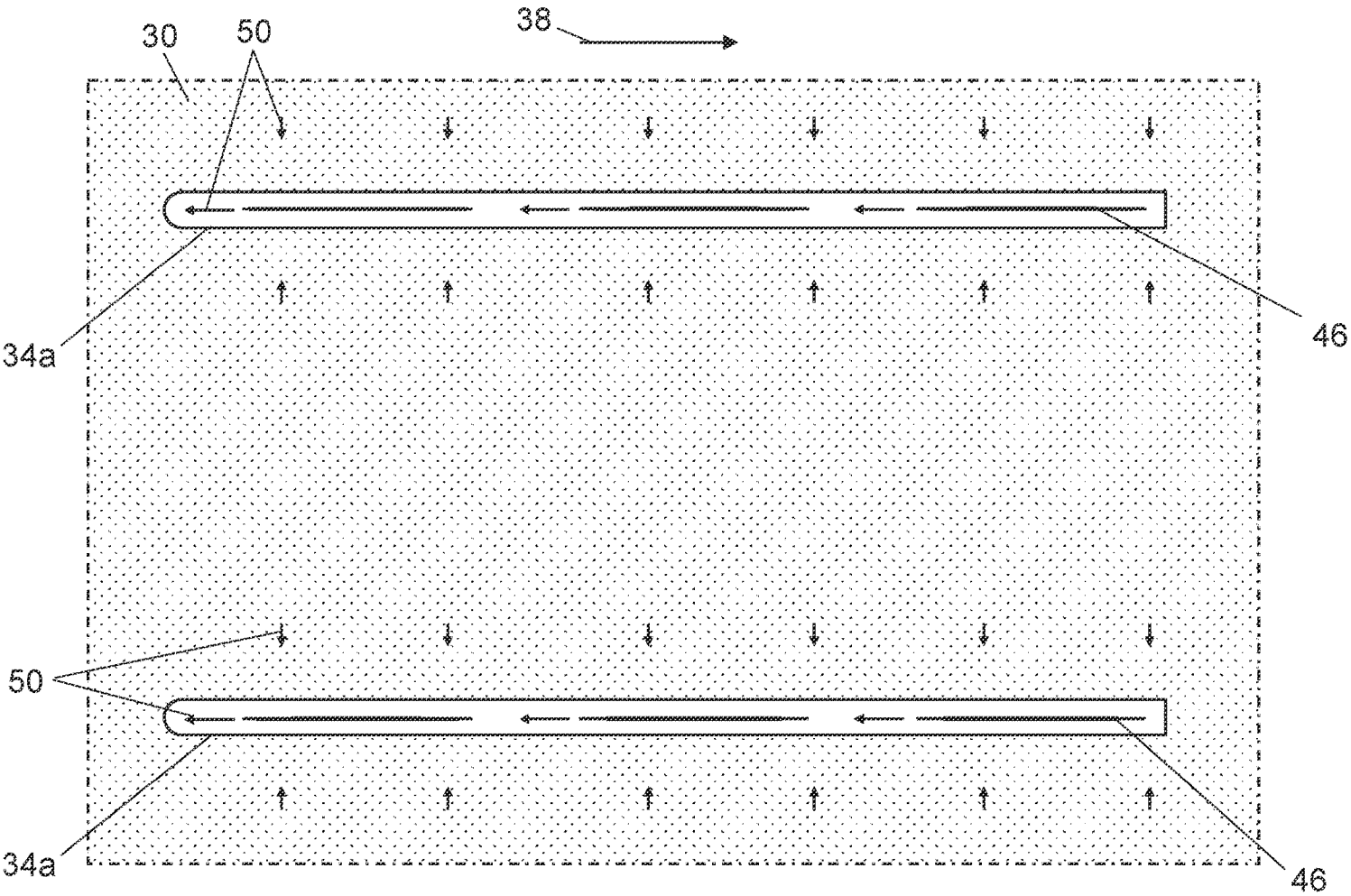

Referring to FIGS. 5A-5F, in embodiments in which there are multiple producer wellbores and/or multiple injector wellbores, the producer and injector wellbores need not be drilled at the same time. Initially, at least two of the laterals can be drilled such that a first one of the laterals is separated from a second one of the laterals by a distance (e.g., 66) that is larger than (e.g., is at least 150%, 160%, 170%, 180%, 190%, 200%, 210%, or 220% of) the above-described target well spacings (FIG. 5A). As show, the two laterals initially drilled are first and second producer wellbores, although in some embodiments at least one of the initially-drilled laterals can be an injector wellbore. Those wellbores can be longitudinally fractured (FIG. 5B), and primary recovery in which formation hydrocarbons are received into at least one—up to and including each—of the wellbores can be performed (FIG. 5C). Optionally, at least one of the first and second laterals can be used as an injector wellbore for secondary recovery in which fluid is injected into the injector wellbore and formation hydrocarbons are received into a producer wellbore.

Figure 5D:
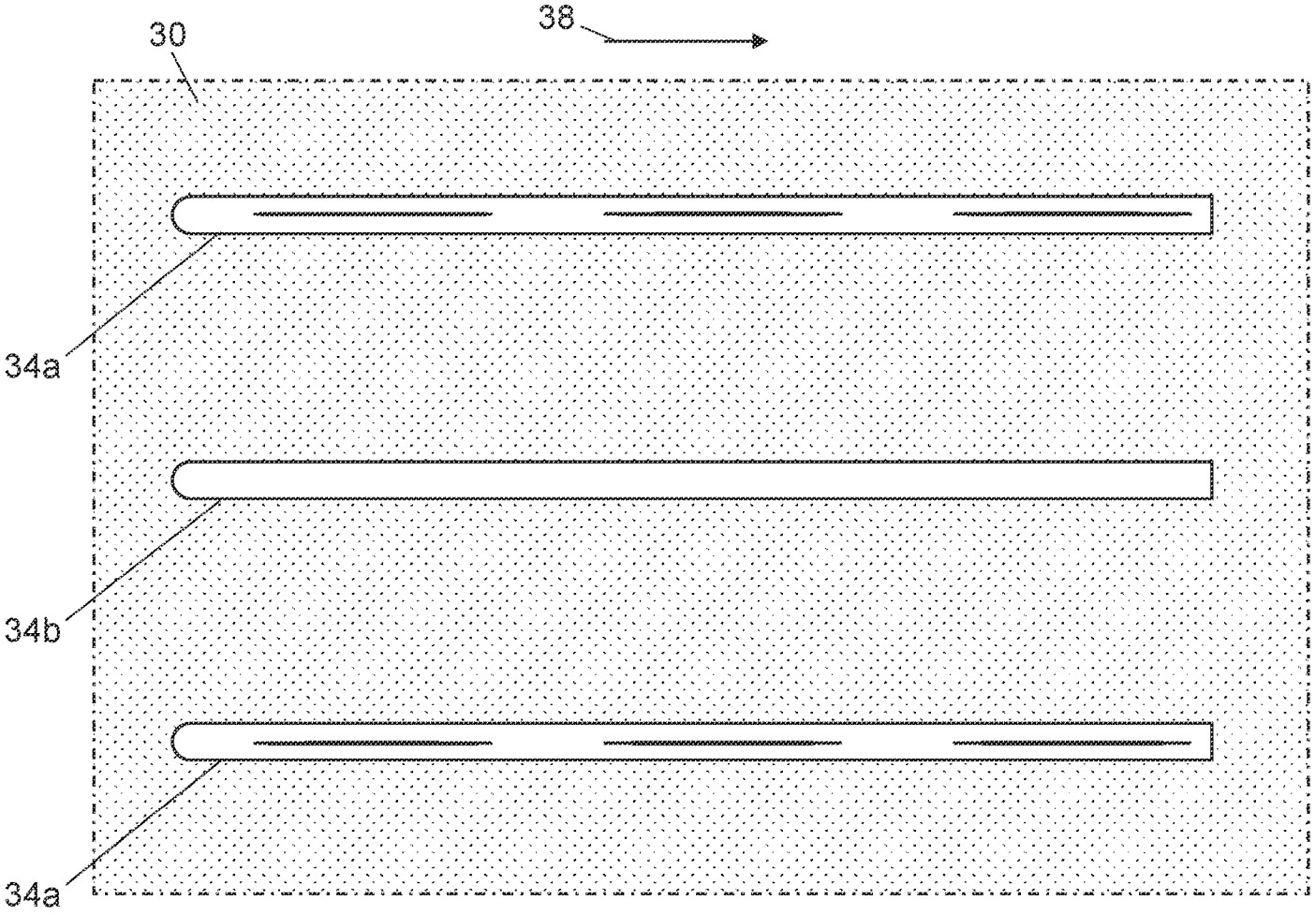
FIG. 5D is a top cross-sectional view of the formation of FIG. 5A in which an additional lateral is drilled in the formation, the additional lateral being used as an injector lateral, wherein the spacing between the injector lateral and each of the original producer laterals is smaller than the spacing between the original producer laterals.
Figure 5E:
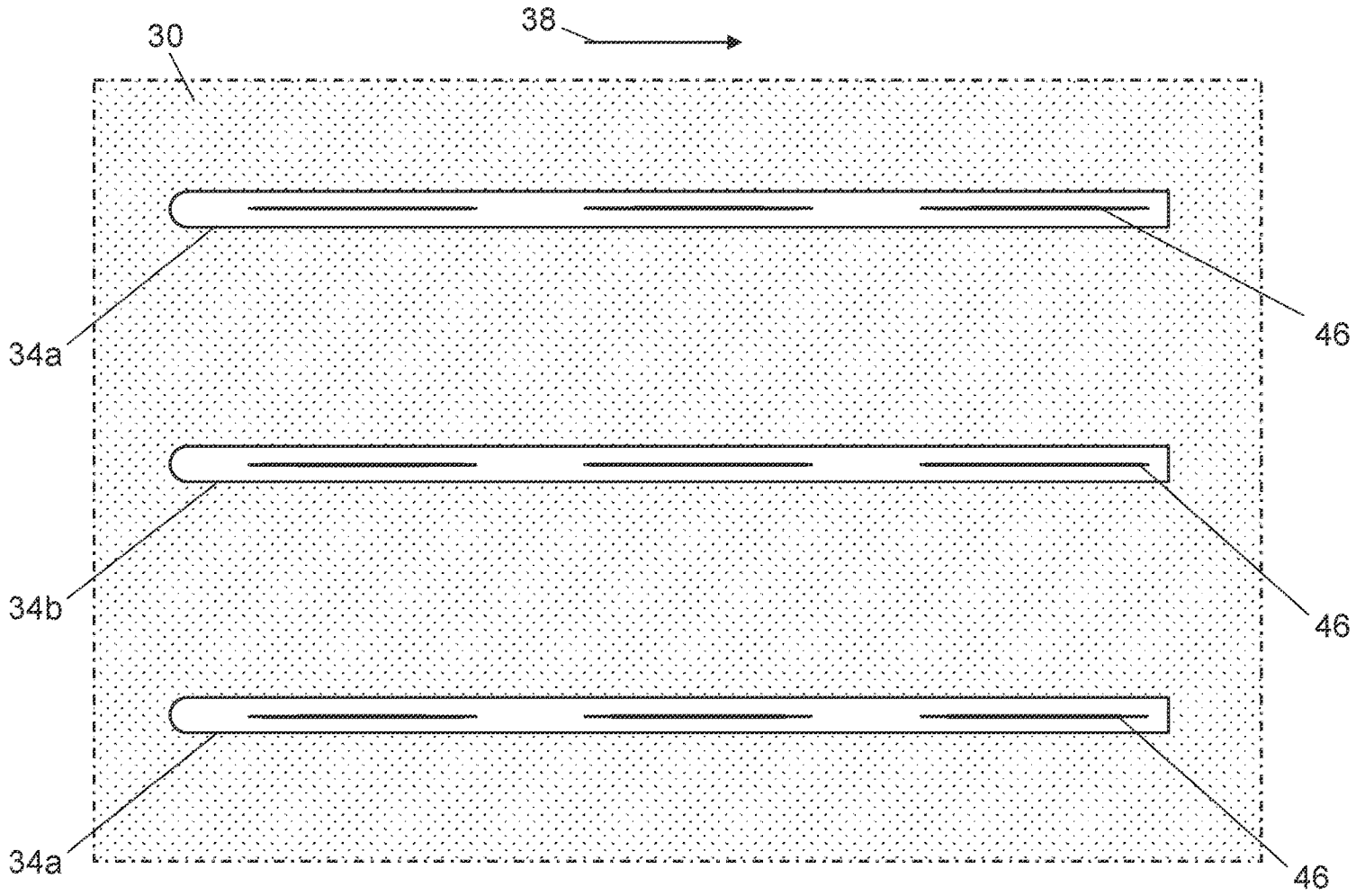
FIGS. 5E and 5F are top cross-sectional views of the formation of FIG. 5A and illustrate fracturing of the additional injector lateral and secondary recovery in which gas is injected into the injector lateral and hydrocarbons from the formation are received in each of the producer laterals.
Figure 5F:
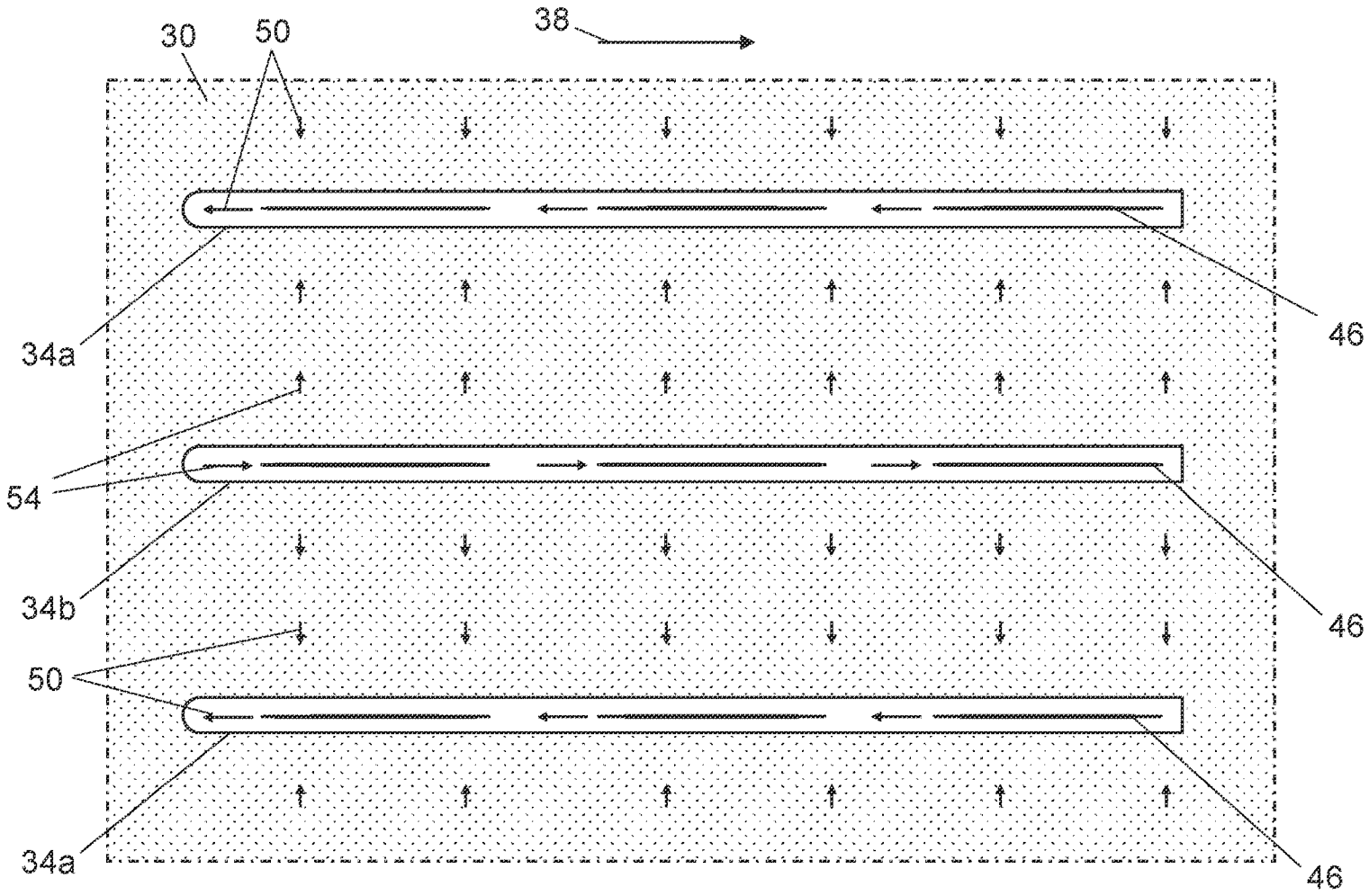

After some time during which primary and/or secondary recovery occurs through the initially-drilled laterals (e.g., at least 1, 2, 3, 4, 5, 6, 7, 8, 9, or 10 years after the first and second laterals are drilled), a third one of the laterals (e.g., an infill) can be drilled between the first and second laterals, e.g., such that the third lateral is positioned closer to each of the first and second laterals (e.g., the first and second producer wellbores, as shown) than is the first wellbore to the second wellbore (FIG. 5D). The well spacing between the third lateral and each of the first and second laterals can be any of the target spacings described above (e.g., within one of the above-described ranges or within 10% of Eq. 5). In this manner, secondary recovery patterns can be performed at the initially-targeted spacing; the third lateral can be longitudinally fractured (FIG. 5E) and primary and/or secondary recovery through the laterals can occur as described above with respect to FIGS. 2A-2E. For example, as shown, the first and second laterals can each be a producer wellbore and the third lateral can be an injector wellbore; in other embodiments, however, the third lateral can be a producer wellbore and the first and second laterals can each be an injector wellbore (regardless of whether the first and second laterals were initially used as producer wellbores). Drilling infills can delay capital expenditures and offer more flexibility in reacting to fluctuating oil prices, each of which can improve the economics of hydrocarbon production. To illustrate, if the price of oil remains low after producing with the first and second laterals, keeping the well spacing without further drilling may be desirable. While reservoir depletion may take longer without further drilling (even if gas flooding is performed with the first and second laterals), such a delay in production may be a preferable strategy at low oil prices.

While the above-described methods can be performed to recover hydrocarbons from new formations or formations with limited disturbance, they can also be performed in formations with pre-existing wells. For example, some early tight oil fields may have been produced with vertical wells or near-vertical wells that may have been fractured and, in some cases, water flooded. In these cases, the field may be redesigned for the above-described secondary recovery patterns in which gas flooding occurs between producer and injector wellbores that extend substantially in the maximum horizontal stress direction by plugging and abandoning the pre-existing wells and treating the formation as a new formation. Alternatively, one or more of the pre-existing wells can be used when drilling the above-described laterals, such as by drilling (and, optionally, fracturing) one or more of the laterals to extend from at least one pre-existing wellbore and/or abandoning one or more of the pre-existing wells and drilling new wells to take their place. The original fractures in pre-existing fractured wells may be parallel to each other; accordingly, during secondary recovery there may not be a significant risk of short circuiting between the longitudinal fractures created in the producer and/or injector wellbores and the original fractures.

As another example, some fields may have been at least partially developed with one or more fractured laterals extending substantially in the direction of minimum horizontal stress (a "LATF" case), such as a drilling spacing unit (DSU) in which multiple wells were planned but only one was drilled. In such cases, the existing well(s) can be plugged and abandoned such that the above-described laterals can be drilled to extend substantially in the direction of maximum horizontal stress throughout the DSU, or such laterals can be drilled in the remaining areas of the DSU without plugging the existing well(s). If a field has gone through full LATF development, the pre-existing wells may be plugged and abandoned and new wells comprising the above-described producer and injector wellbores that, optionally, are longitudinally fractured can be created; some of the pre-existing vertical well sections and fractures may be utilized when drilling and completing the new laterals. On the other hand, LATF wells often do not extend into a portion of the formation at the border of a DSU; in such cases, multiple DSUs can be unitized and a new lateral extending in a direction that is substantially aligned with the original fracture direction (e.g., the maximum horizontal stress direction) can be drilled at the border. Secondary recovery can be performed by injecting the gas-containing recovery fluid into the new lateral and receiving formation hydrocarbons into one or more of the pre-existing LATF wells, or vice versa.

EXAMPLES

The present invention will be described in greater detail by way of specific examples. The following examples are offered for illustrative purposes only and are not intended to limit the present invention in any manner. Those skilled in the art will readily recognize a variety of non-critical parameters that can be changed or modified to yield essentially the same results.

Example 1

To determine what candidate reservoirs and well spacings may yield the most effective secondary recovery using gas flooding, a simulation was performed comparing the oil recovery obtainable with horizontal wells drilled and fractured in accordance with common practice in which the horizontal wells are drilled in the minimum horizontal stress direction "A" and completed with multistage transverse fractures (indicated as "LATF") with the oil recovery obtainable using some of the present methods in which the laterals are drilled along the maximum horizontal stress direction "B" and completed with longitudinal fractures (indicated as "LBLF"). The simulation was also performed to assess oil recovery for cases in which the laterals drilled along the maximum horizontal stress direction were not fractured (indicated as "LBNF"), which was indicative of conditions at which fracturing is necessary.

Figure 6B:
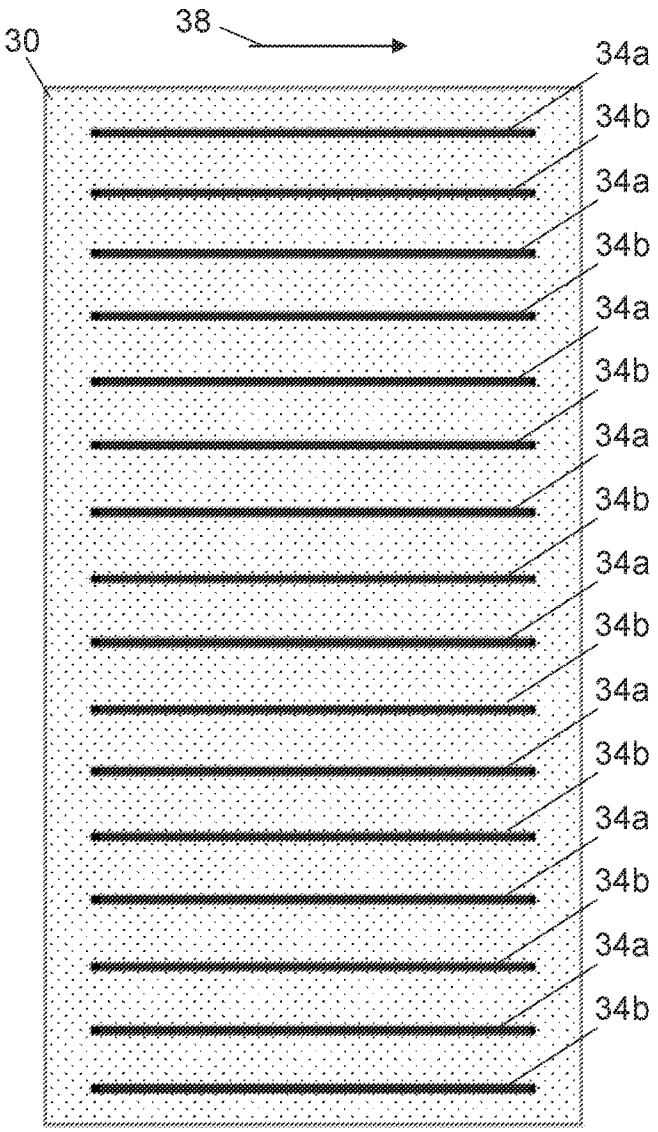
FIG. 6B is a top cross-sectional view of a formation in a 1280-acre DSU in which sixteen laterals are drilled in the formation's direction of maximum horizontal stress and the spacing between each lateral is 640 feet, wherein the laterals can remain unfractured (a "LBNF" case) or can be fractured such that each includes one or more longitudinal fractures (a "LBLF" case).
Figure 6A:
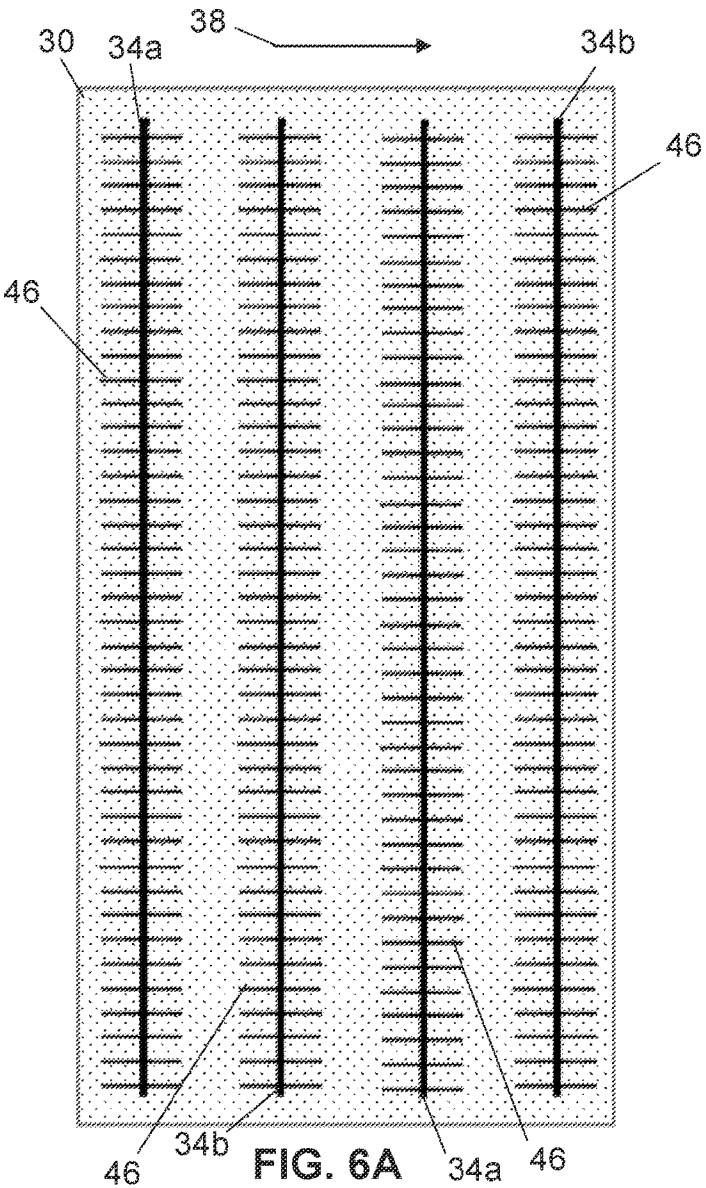
FIG. 6A is a top cross-sectional view of a formation in a 1280-acre drilling space unit (DSU) in which four laterals are drilled in the formation's direction of minimum horizontal stress and fractured (a "LATF" case) such that each lateral includes forty transverse fractures.

As noted above, reservoir permeability and well spacing are two critical parameters for oil recovery in LBLF and LBNF cases, while reservoir permeability and fracturing intensity are two critical parameters affecting oil recovery in LATF cases that serve as a baseline. To compare the LATF, LBLF, and LBNF cases on the same basis, a 2-mile by 1-mile (1280-acre, which is common for production activities) DSU (drilling spacing unit, also referred to as a drilling unit (DU), or an area) was used for the simulation. Three different drilling and completion designs were simulated for the LATF cases: (1) four 2-mile-long laterals that each included forty transverse fractures evenly placed along the lateral ("LATF 40×4"), (2) four 2-mile-long laterals that each included eighty transverse fractures evenly placed along the lateral ("LATF 80×4"), and (3) eight two-mile laterals that each included eighty transverse fractures evenly placed along the lateral ("LATF 80×8"). FIG. 6A illustrates the LATF 40×4 design. Three different well spacings between laterals were simulated for the LBLF and LBNF cases: (1) a 320-foot well spacing with thirty-two laterals, (2) a 640-foot well spacing with sixteen laterals, and (3) a 1280-foot well spacing with eight laterals. Each lateral in the LBLF and LBNF cases was 1-mile long, with the laterals evenly placed on the 1280-acre DSU. FIG. 6B illustrates the lateral positioning for the LBLF and LBNF cases with a 640-foot well spacing.

In the simulation, the reservoir was modelled to include light oil (40° API oil) and the gas injected in the injector wellbores was modelled to be methane. All wells underwent primary depletion before selected wells (every other well) were converted to injectors to begin a secondary recovery pattern. All the production parameters were assigned reasonable values and kept consistent among the simulated cases. Because time is important in determining the practical feasibility of an oil recovery process, a 20-year total operation period was used for all cases. A discounted cumulative oil recovery at 10% annual percentage rate was used to account for inflation.

Figure 7:
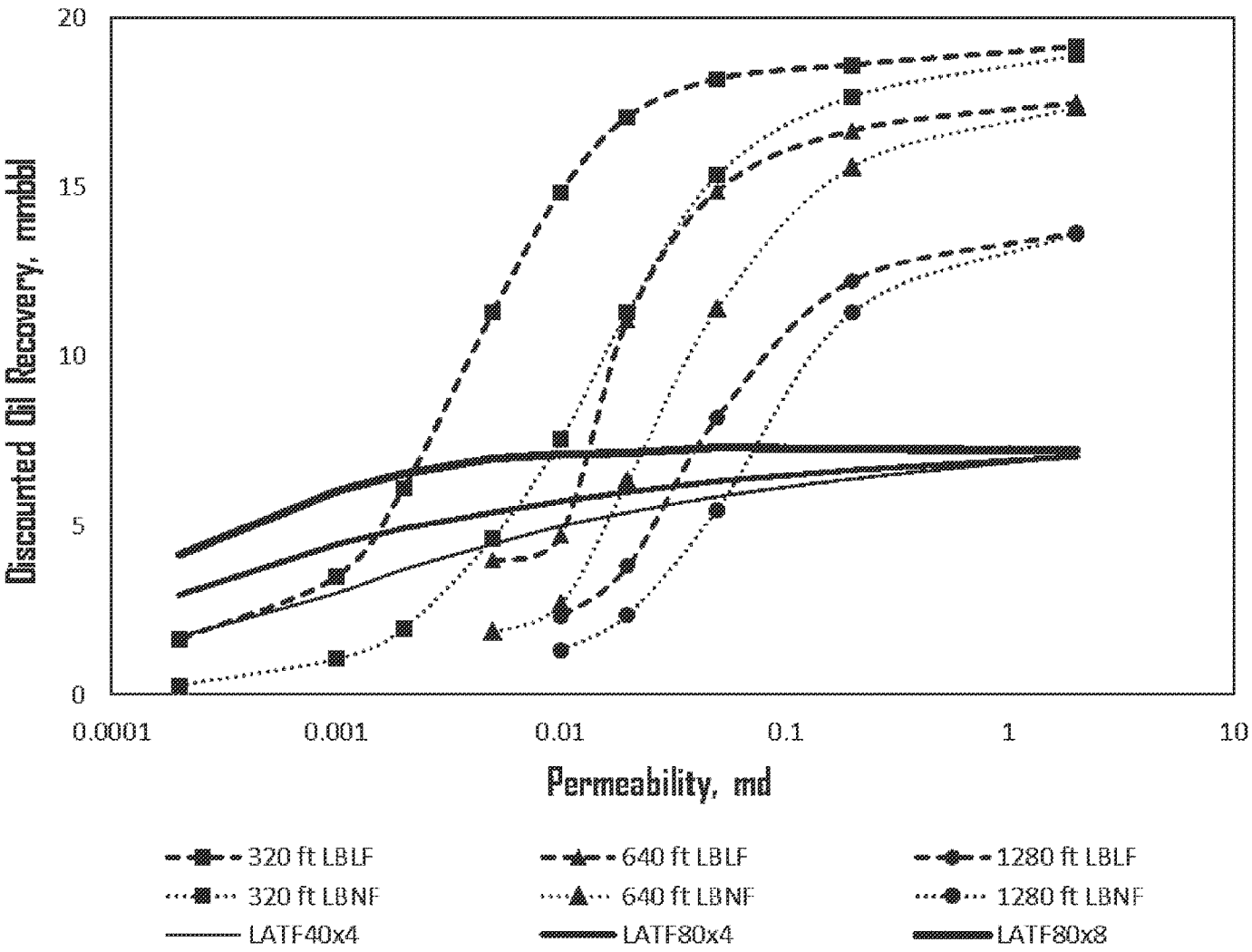
FIG. 7 is a graph comparing oil recovery among nine different LATF, LBLF, and LBNF cases within a 1280-acre DSU.

Referring to FIG. 7, shown are the simulated oil recoveries (discounted with time at a 10% annual rate) from the LATF, LBLF, and LBNF cases over a range of formation permeabilities. As shown, for each of the LBLF and LBNF cases, oil recovery increased rapidly with increasing reservoir permeability over a limited permeability range; however, each of the oil recovery curves began to flatten at a threshold permeability. For each curve, the well spacing associated with the curve roughly represented the maximum spacing ($L_{max}$) that allowed proper depletion within a reasonable amount of time when the formation's average permeability equaled the curve's threshold permeability. As reflected in FIG. 7, lower permeabilities required smaller well spacings for more effective recovery, and smaller spacing yielded higher maximum recovery due to faster and more effective depletion. However, smaller well spacings required more wells to be drilled. In view of this, to achieve effective secondary recovery, at each permeability the minimum well spacing was estimated to be the smallest of 0.5 times $L_{max}$ or 200 feet, and the maximum well spacing was determined to be 1.5 times $L_{max}$. The value of $L_{max}$ at each permeability is determinable by interpolating FIG. 7 based on the recovery curves' threshold permeabilities. For example, the threshold permeability of the 320 ft LBLF recovery curve is approximately 0.02 mD, therefore the $L_{max}$ for 0.02 mD is approximately 320 ft. As another example, the threshold permeability of the 640 ft LBLF recovery curve is approximately 0.08 mD, therefore the $L_{max}$ for 0.08 mD is approximately 640 ft. As a further example, while the curves shown in FIG. 7 do not have a threshold permeability at 0.05 mD, the $L_{max}$ at 0.05 mD can be determined through interpolation—a curve between the 320 ft LBLF and 640 ft LBLF curves would have a threshold permeability of 0.05 mD, and thus the $L_{max}$ at 0.05 mD can be approximated as 480 ft (the average of 320 ft and 640 ft). The simulation indicated that, using proper well spacings within these ranges, the oil recoveries from LBLF and LBNF cases can each be 2-4 times the oil recoveries from LATF. Also, the difference in oil recovery between the LBLF and LBNF cases diminished as the permeability increased above approximately 1 mD, indicating that fracturing would not necessarily yield more recovery in such conditions.

Example 2

Figure 8A:
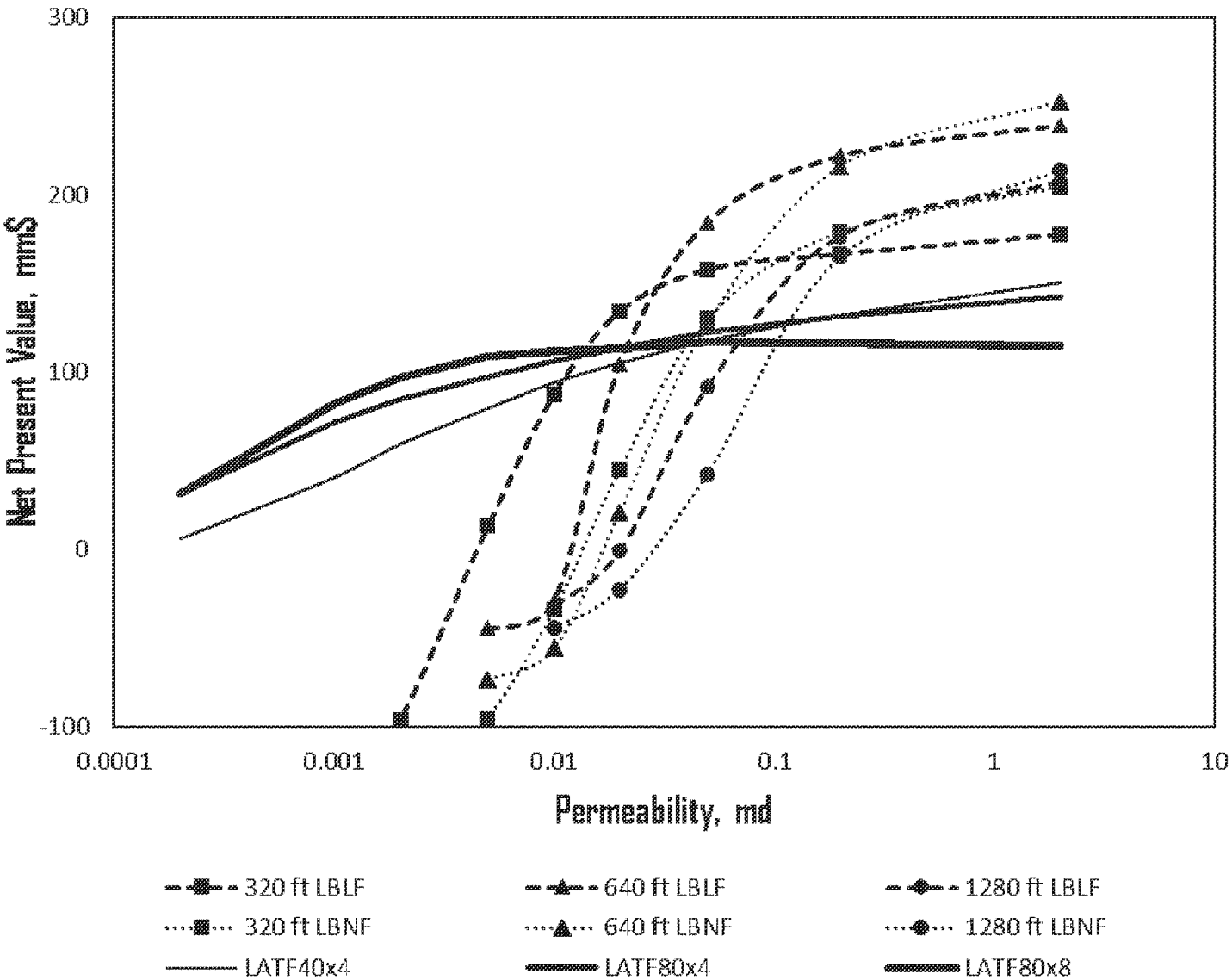
FIGS. 8A-8C are graphs comparing the net present value (NPV) among nine different LATF, LBLF, and LBNF cases within a 1280-acre DSU, at an oil price of $50, $100, and $40 per barrel ("bbl"), respectively.
Figure 8B:
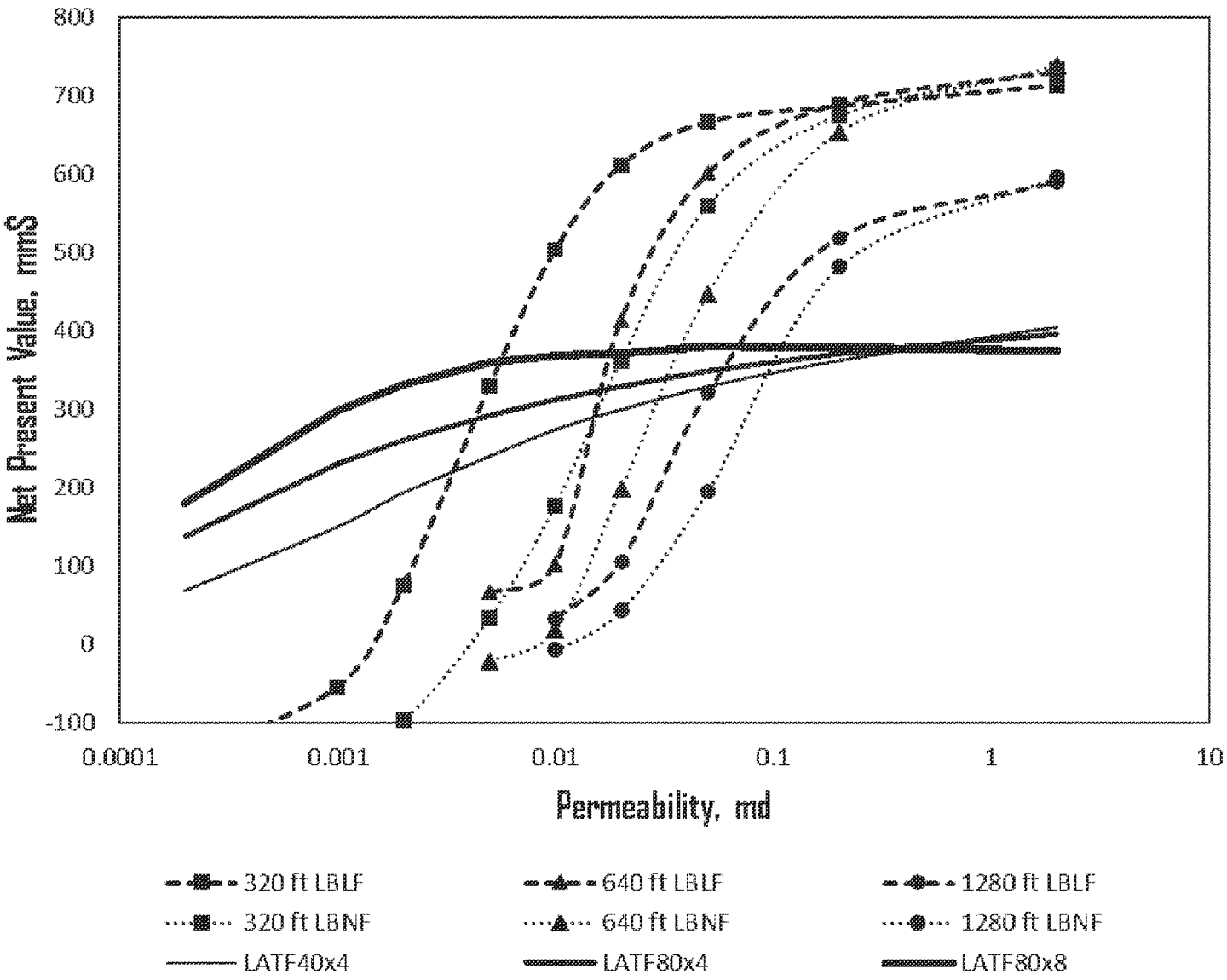
Figure 8C:
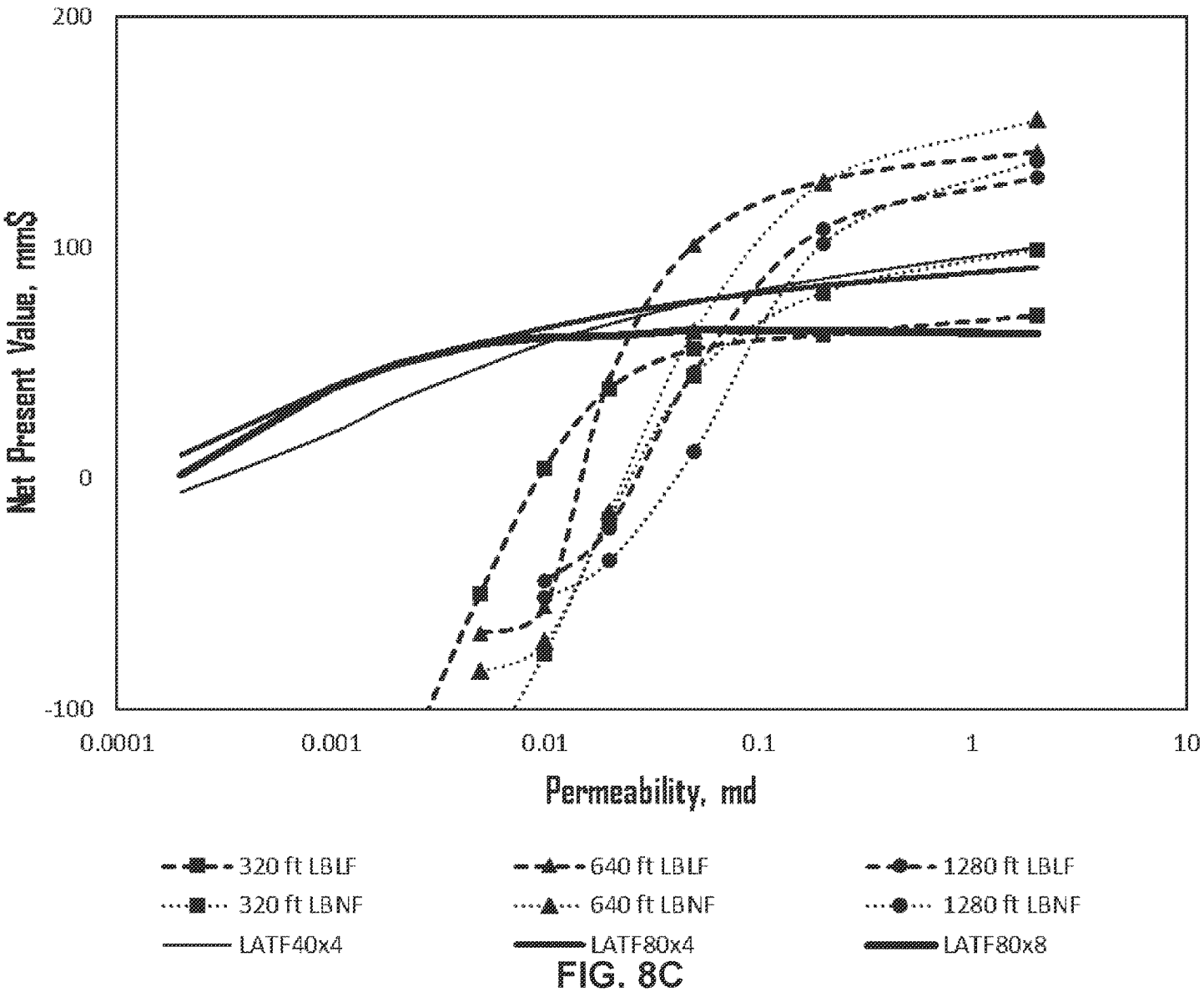

Referring to FIGS. 8A-8D, economic calculations were conducted for the Example 1 LATF, LBLF, and LBNF simulations to assess which well spacings were economically appropriate at different conditions. The calculations included determining the Net Present Value (NPV) of the 1280-acre DSU in each case for three different oil prices: (1) $50/bbl (FIG. 8A), (2) $100/bbl (FIG. 8B), and (3) $40/bbl (FIG. 8C). Reasonable values were assigned for the various costs and expenses incorporated in the NPV calculation. Correction factors were applied on oil recoveries to account for the effect of reservoir heterogeneity.

At an oil price of $50/bbl, for reservoir permeabilities between about 0.01 and 0.20 mD the LBLF cases yielded the highest NPV (FIG. 8A), indicating that such cases were preferable at these permeabilities. Additionally, of the three different LBLF cases, the case with a 320-foot well spacing yielded the highest NPV over permeabilities that were between about 0.01 and 0.03 mD and the case with a 640-foot well spacing yielded the highest NPV over permeabilities that were between about 0.03 and 0.20 mD. While different assumptions could have changed the NPV calculations, the results indicated that an LBLF case could yield significant economic benefits over an LATF case.

FIGS. 8B and 8C illustrate the effect of one assumption—oil price—on NPV and the determination of which well spacings yield the most economic recovery. At the $100/bbl oil price (FIG. 8B), for reservoir permeabilities between about 0.005 and 1 mD the LBLF cases yielded the highest NPV, with the 320-foot well spacing yielding the highest NPV when the reservoir permeability was between about 0.005 and 0.20 mD and the 640-foot well spacing yielding the highest NPV when the reservoir permeability was between 0.20 and 1.0 mD. As this illustrated, higher oil prices can expand the range of reservoir permeabilities over which an LBLF case is economically viable and preferable. Additionally, smaller well spacings yielded higher NPVs at lower permeabilities, indicating that the lower limit of permeabilities over which an LBLF process was economically viable and preferable would be extended with well spacings smaller than 320 feet; the optimal spacing could vary at the different permeabilities. At the $40/bbl oil price (FIG. 8C), for reservoir permeabilities between about 0.03 and 0.20 mD, the 640-foot-well-spacing LBLF cases yielded the highest NPV. Again, a change in assumptions such as oil price would have changed the NPV calculations and the permeability range and well spacing over which the LBLF process is economically preferable to an LATF process. Nevertheless, the above-described general trends indicate that the LBLF gas flooding process can be an advantageous option for formations with a light oil reservoir having an average permeability that is between about 0.001 and 2.0 mD, with average permeabilities between about 0.005 and 0.50 mD (or, more specifically, less than or equal to 0.10 mD) being particularly good candidates.

Figure 8D:
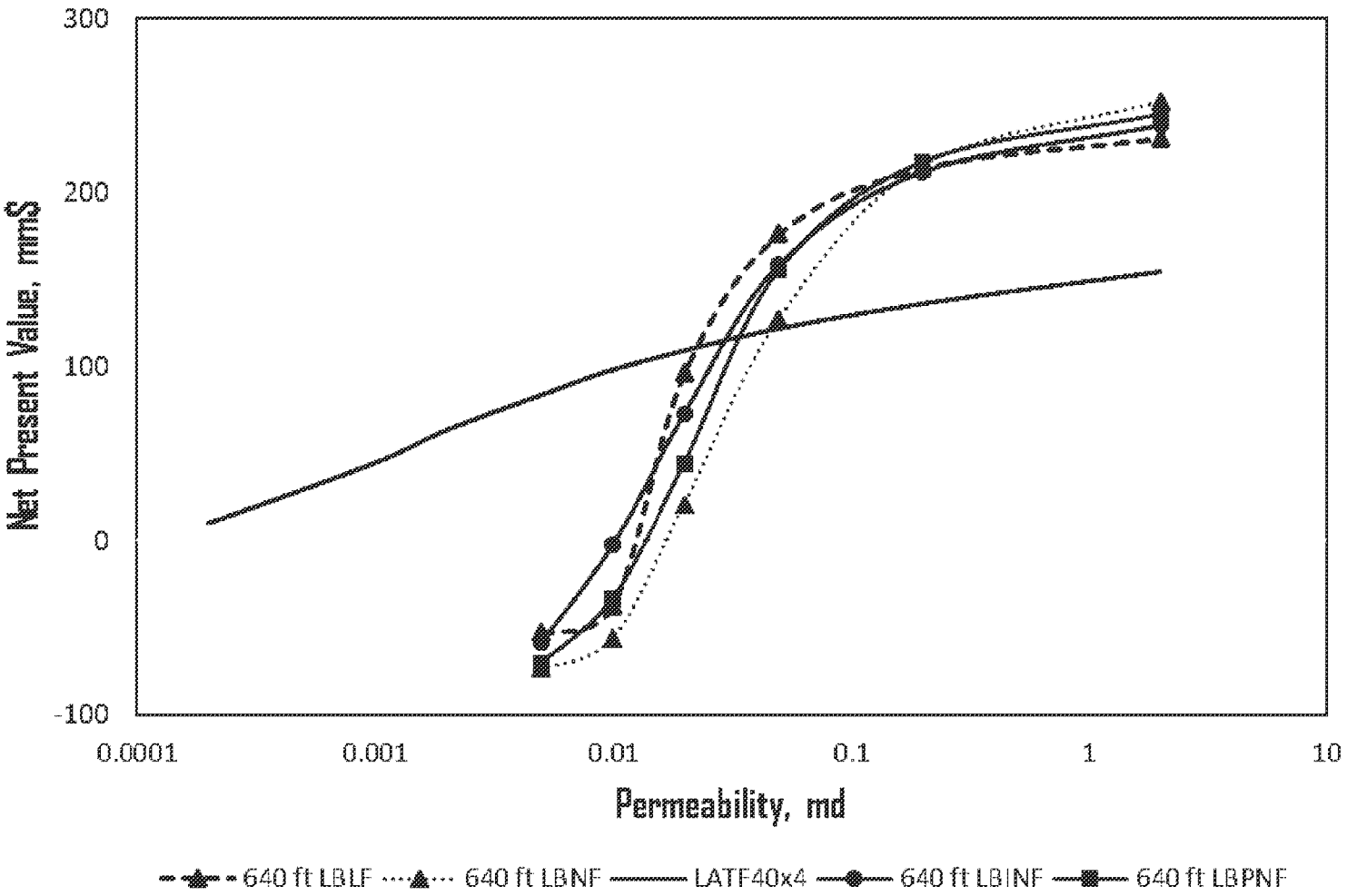
FIG. 8D is a graph comparing NPV among five different drilling cases that include a LATF case with four laterals that each have 40 transverse fractures, and four cases in which the laterals are drilled in the formation's direction of maximum horizontal stress with a well spacing of 640 feet: an LBLF case, an LBNF case, a case in which only the injector laterals are fractured ("LBPNF"), and a case in which only the producer laterals are fractured ("LBINF").

Comparing the LBLF and LBNF cases, at the same well spacing the differences in oil recoveries between the two methods became less significant as the reservoir permeability increased toward 1.0 mD. Accordingly, the NPV of a DSU employing the LBNF process tended to exceed the NPV of a DSU employing the LBLF process as the reservoir permeability approached and exceeded 1.0 mD, meaning that fracturing was not economically beneficial at higher permeabilities. This all indicated that using small longitudinal fractures and/or fracturing only a portion of the producer and injector wellbores can be economically advantageous when the formation permeability is between about 0.1 and 2.0 mD. To illustrate, FIG. 8D illustrates the simulated NPVs of the 640-foot-well-spacing LBLF process (with both injector and producer wellbores being longitudinally fractured), the 640-foot-well-spacing LBNF process (with neither the injector nor the producer wellbores being fractured), a 640-foot-well-spacing LBINF process (which was simulated to be the same as the 640-foot-well-spacing LBLF process except that only the producer wellbores were longitudinally fractured), and a 640-foot-well-spacing LBPNF process (which was simulated to be the same as the 640-foot-well-spacing LBLF process except that only the injector wellbores were longitudinally fractured). As shown in FIG. 8D, the NPV differences between these cases were relatively small when the reservoir permeability was between approximately 0.10 and 2.0 mD.

Example 3

Sample well spacing calculations were performed using Eq. 5 based on a T of between 0.5 and 15 years, which yielded well spacings between approximately:

$$(1\text{–}6)\times\sqrt{\frac{k\Delta p}{\phi(1-S_w)\mu}} \tag{6}$$

For example, with values of T being 1, 2, 3, 4, 5, 6, 8, 10, and 12 years the appropriate well spacing according to Eq. 5 was:

$$(1.5,\ 2.2,\ 2.6,\ 3.4,\ 3.7,\ 4.3,\ 4.8,\ 5.3)\times\sqrt{\frac{k\Delta p}{\phi(1-S_w)\mu}}\,. \tag{7}$$

With $\Delta p$=5000 psi, $\phi$=0.06, $S_w$=0.2, and $\bar{\mu}$=0.2 cP (reasonable parameters to expect in at least some formations), the range in Eq. 6 was:

$$(842-5052)\times\sqrt{k} \tag{8}$$

Figure 9:
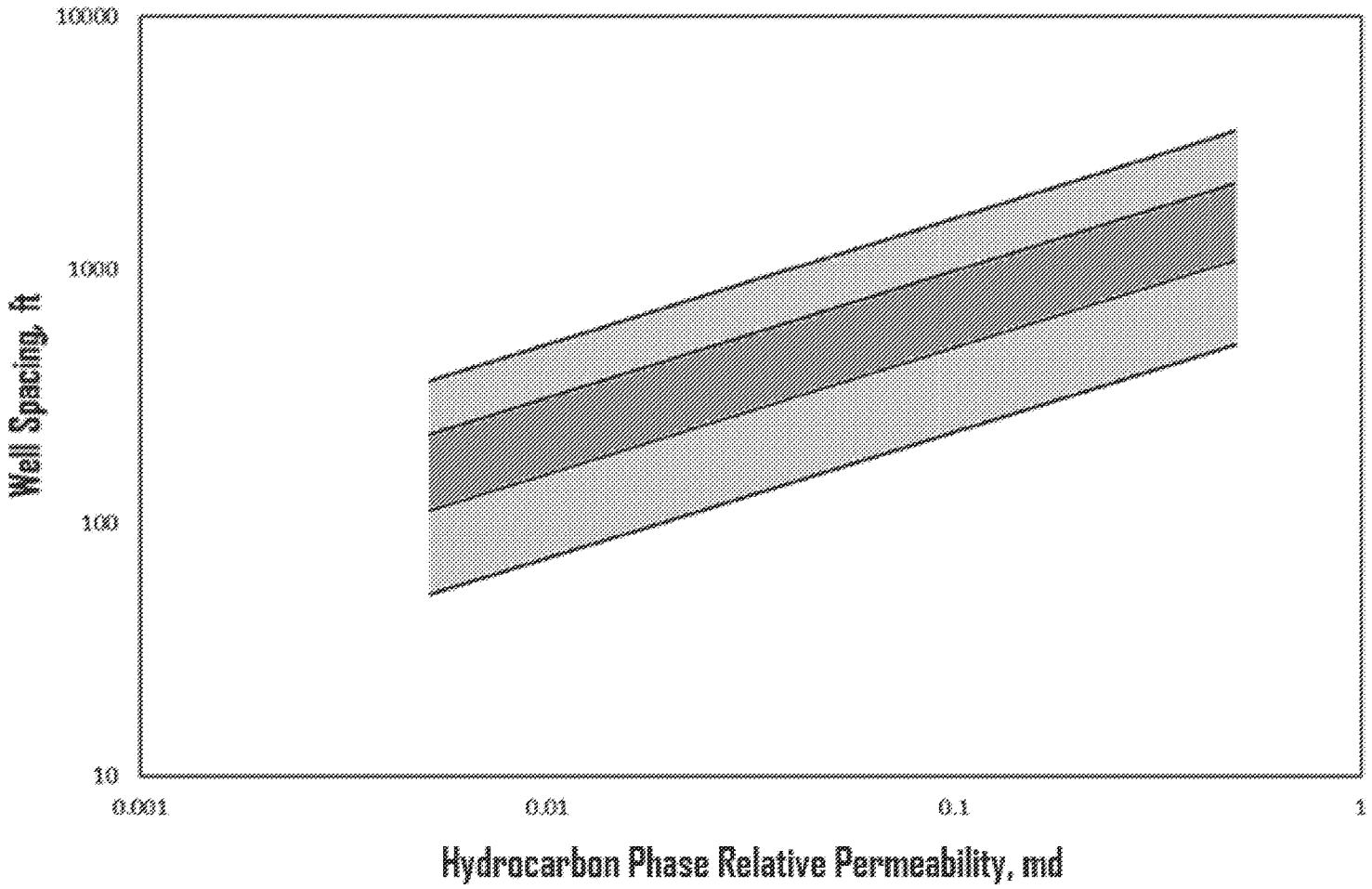
FIG. 9 is a graph illustrating advantageous well spacing versus hydrocarbon permeability for secondary recovery using laterals drilled in the formation's direction of maximum horizontal stress.

FIG. 9 illustrates the range of appropriate well spacings in this example over a range of formation permeabilities, shown in grey. A narrower well spacing range based on a T of between 2 and 8 years (setting the lower and upper bounds of the range) is shown in dark grey. FIG. 9 illustrates how well spacing selections according to Eq. 5 can be linearly related to $k^{0.5}$ and how the well spacing range can be estimated at each permeability. Based on the well spacing range, economic calculations may be used to select a particular well spacing within the range. At higher oil prices, smaller values for T and thus smaller well spacings may be preferred to take advantage of the higher oil prices; at lower oil prices, larger well spacings may be preferred as cost reduction from fewer number of wells becomes more important.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the products, systems, and methods are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing, and wherein the average permeability of the formation is at least 0.001 and less than 0.005 mD, and the well spacing is between 50 and 300 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

2. The method of claim 1, wherein:

the one or more producer wellbores comprise two or more producer wellbores, wherein for each of the producer wellbores a distance between the producer wellbore and at least one of the injector wellbore(s) is less than a distance between the producer wellbore and each other of the producer wellbores; and/or the one or more injector wellbores comprise two or more injector wellbores, wherein for each of the injector wellbores a distance between the injector wellbore and at least one of the producer wellbore(s) is less than a distance between the injector wellbore and each other of the injector wellbores; and each of the producer wellbore(s) is spaced apart from each of the injector wellbore(s) by a distance that is greater than or equal to the well spacing.

3. The method of claim 1, wherein a depth of each of the horizontal wellbores is within 5% of a depth of each other of the horizontal wellbores.

4. The method of claim 1, wherein drilling is performed such that at least two of the horizontal wellbores extend from a common vertical wellbore.

5. The method of claim 1, wherein at least one of the producer wellbore(s) and/or at least one of the injector wellbore(s) has a length that is between 100 feet and 90% of the length of another one of the horizontal wellbores.

6. The method of claim 1, wherein the gas comprises methane, ethane, propane, butane, carbon dioxide, and/or nitrogen.

7. The method of claim 1, wherein:

the one or more producer wellbores comprise two or more producer wellbores;

drilling is performed such that:

a first one of the producer wellbores is spaced apart from a second one of the producer wellbores by a distance that is between 150% and 200% of the well spacing;

a first one of the injector wellbore(s) is spaced apart from each of the first and second producer wellbores by the well spacing; and the first injector wellbore is:

drilled in the formation at least one year after the first and second producer wellbores are each drilled in the formation;

wherein a distance between the first injector wellbore and the first producer wellbore and a distance between the first injector wellbore and the second producer wellbore are each less than a distance between the first producer wellbore and the second producer wellbore; and receiving hydrocarbons from the formation includes receiving hydrocarbons into the first and second producer wellbores before the first injector wellbore is drilled in the formation.

8. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing; and, wherein:

the average permeability of the formation is at least 0.005 mD and less than 0.01 mD, and the well spacing is between 100 and 800 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

9. The method of claim 8, wherein:

the one or more producer wellbores comprise two or more producer wellbores;

drilling is performed such that:

a first one of the producer wellbores is spaced apart from a second one of the producer wellbores by a distance that is between 150% and 200% of the well spacing;

a first one of the injector wellbore(s) is spaced apart from each of the first and second producer wellbores by the well spacing; and the first injector wellbore is:

drilled in the formation at least one year after the first and second producer wellbores are each drilled in the formation;

wherein a distance between the first injector wellbore and the first producer wellbore and a distance between the first injector wellbore and the second producer wellbore are each less than a distance between the first producer wellbore and the second producer wellbore; and receiving hydrocarbons from the formation includes receiving hydrocarbons into the first and second producer wellbores before the first injector wellbore is drilled in the formation.

10. The method of claim 8, wherein:

the one or more producer wellbores comprise two or more producer wellbores, wherein for each of the producer wellbores a distance between the producer wellbore and at least one of the injector wellbore(s) is less than a distance between the producer wellbore and each other of the producer wellbores; and/or the one or more injector wellbores comprise two or more injector wellbores, wherein for each of the injector wellbores a distance between the injector wellbore and at least one of the producer wellbore(s) is less than a distance between the injector wellbore and each other of the injector wellbores; and each of the producer wellbore(s) is spaced apart from each of the injector wellbore(s) by a distance that is greater than or equal to the well spacing.

11. The method of claim 8, wherein at least one of the producer wellbore(s) and/or at least one of the injector wellbore(s) has a length that is between 100 feet and 90% of the length of another one of the horizontal wellbores.

12. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing; and, wherein:

the average permeability of the formation is at least 0.01 mD and less than 0.05 mD, and the well spacing is between 150 and 1,500 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

13. The method of claim 12, wherein the well spacing is between 150 and 900 feet.

14. The method of claim 12, wherein:

the one or more producer wellbores comprise two or more producer wellbores;

drilling is performed such that:

a first one of the producer wellbores is spaced apart from a second one of the producer wellbores by a distance that is between 150% and 200% of the well spacing;

a first one of the injector wellbore(s) is spaced apart from each of the first and second producer wellbores by the well spacing; and the first injector wellbore is:

drilled in the formation at least one year after the first and second producer wellbores are each drilled in the formation;

wherein a distance between the first injector wellbore and the first producer wellbore and a distance between the first injector wellbore and the second producer wellbore are each less than a distance between the first producer wellbore and the second producer wellbore; and receiving hydrocarbons from the formation includes receiving hydrocarbons into the first and second producer wellbores before the first injector wellbore is drilled in the formation.

15. The method of claim 12, wherein:

the one or more producer wellbores comprise two or more producer wellbores, wherein for each of the producer wellbores a distance between the producer wellbore and at least one of the injector wellbore(s) is less than a distance between the producer wellbore and each other of the producer wellbores; and/or the one or more injector wellbores comprise two or more injector wellbores, wherein for each of the injector wellbores a distance between the injector wellbore and at least one of the producer wellbore(s) is less than a distance between the injector wellbore and each other of the injector wellbores; and each of the producer wellbore(s) is spaced apart from each of the injector wellbore(s) by a distance that is greater than or equal to the well spacing.

16. The method of claim 12, wherein at least one of the producer wellbore(s) and/or at least one of the injector wellbore(s) has a length that is between 100 feet and 90% of the length of another one of the horizontal wellbores.

17. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing; and, wherein:

the average permeability of the formation is at least 0.05 mD and less than 0.10 mD, and the well spacing is between 200 and 2,000 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

18. The method of claim 17, wherein the well spacing is between 200 and 900 feet.

19. The method of claim 17, wherein:

the one or more producer wellbores comprise two or more producer wellbores;

drilling is performed such that:

a first one of the producer wellbores is spaced apart from a second one of the producer wellbores by a distance that is between 150% and 200% of the well spacing;

a first one of the injector wellbore(s) is spaced apart from each of the first and second producer wellbores by the well spacing; and the first injector wellbore is:

drilled in the formation at least one year after the first and second producer wellbores are each drilled in the formation;

wherein a distance between the first injector wellbore and the first producer wellbore and a distance between the first injector wellbore and the second producer wellbore are each less than a distance between the first producer wellbore and the second producer wellbore; and receiving hydrocarbons from the formation includes receiving hydrocarbons into the first and second producer wellbores before the first injector wellbore is drilled in the formation.

20. The method of claim 17, wherein:

the one or more producer wellbores comprise two or more producer wellbores, wherein for each of the producer wellbores a distance between the producer wellbore and at least one of the injector wellbore(s) is less than a distance between the producer wellbore and each other of the producer wellbores; and/or the one or more injector wellbores comprise two or more injector wellbores, wherein for each of the injector wellbores a distance between the injector wellbore and at least one of the producer wellbore(s) is less than a distance between the injector wellbore and each other of the injector wellbores; and each of the producer wellbore(s) is spaced apart from each of the injector wellbore(s) by a distance that is greater than or equal to the well spacing.

21. The method of claim 17, wherein at least one of the producer wellbore(s) and/or at least one of the injector wellbore(s) has a length that is between 100 feet and 90% of the length of another one of the horizontal wellbores.

22. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing; and, wherein:

the average permeability of the formation is at least 0.10 mD and less than 0.50 mD, and the well spacing is between 500 and 3,000 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

23. The method of claim 22, wherein the well spacing is between 500 and 900 feet.

24. The method of claim 23, wherein the average permeability of the formation is at least 0.10 and less than or equal to 0.11 mD.

25. A method of producing hydrocarbons from a formation, the method comprising:

drilling two or more horizontal wellbores in the formation, wherein:

at least a portion of each of the horizontal wellbores extends in a direction that is within 20 degrees of parallel to a direction of maximum horizontal stress of the formation;

the horizontal wellbores include one or more producer wellbores and one or more injector wellbores, each of the producer wellbore(s) separated from at least one of the injector wellbore(s) by a well spacing; and, wherein:

the average permeability of the formation is at least 0.50 mD and less than or equal to 2.0 mD, and the well spacing is between 800 and 4,000 feet;

creating one or more longitudinal fractures that are in communication with the formation in each of the horizontal wellbores, the longitudinal fracture(s) created with a fracturing fluid;

injecting a recovery fluid into at least one of the injector wellbore(s) such that the recovery fluid flows into the formation, wherein the recovery fluid comprises gas; and receiving hydrocarbons from the formation into at least one of the producer wellbore(s) at least when the recovery fluid is in the formation.

26. The method of claim 25, wherein the well spacing is between 800 and 900 feet.

* * * * *